US009812769B2

(12) United States Patent
Koga et al.

(10) Patent No.: US 9,812,769 B2
(45) Date of Patent: Nov. 7, 2017

(54) ANTENNA APPARATUS

(71) Applicant: FUJITSU LIMITED, Kawasaki-shi, Kanagawa (JP)

(72) Inventors: Yohei Koga, Kawasaki (JP); Hiroyuki Egawa, Fukuoka (JP)

(73) Assignee: FUJITSU LIMITED, Kawasaki (JP)

( * ) Notice: Subject to any disclaimer, the term of this patent is extended or adjusted under 35 U.S.C. 154(b) by 1 day.

(21) Appl. No.: 15/189,436

(22) Filed: Jun. 22, 2016

(65) Prior Publication Data

US 2017/0033453 A1 Feb. 2, 2017

(30) Foreign Application Priority Data

Jul. 27, 2015 (JP) ..... 2015-148145

(51) Int. Cl.

| | |
|---|---|
| ***H01Q 1/38*** | (2006.01) |
| ***H01Q 1/48*** | (2006.01) |
| ***H01Q 1/24*** | (2006.01) |
| ***H01Q 9/42*** | (2006.01) |
| ***H01Q 5/371*** | (2015.01) |
| ***H01Q 5/328*** | (2015.01) |

(52) U.S. Cl.

CPC ..... *H01Q 1/48* (2013.01); *H01Q 1/243* (2013.01); *H01Q 5/328* (2015.01); *H01Q 5/371* (2015.01); *H01Q 9/42* (2013.01)

(58) Field of Classification Search

CPC ..... H01Q 1/38; H01Q 1/24
USPC ..... 343/700 MS
See application file for complete search history.

(56) References Cited

U.S. PATENT DOCUMENTS

| | | | | |
|---|---|---|---|---|
| 8,094,079 | B2 * | 1/2012 | Schlub | H01Q 1/243 343/700 MS |
| 8,890,762 | B2 * | 11/2014 | Wong | H01Q 1/243 343/848 |
| 9,722,294 | B2 * | 8/2017 | Chen | H01Q 1/1207 |
| 2003/0193438 | A1 | 10/2003 | Yoon | |
| 2004/0058723 | A1 * | 3/2004 | Mikkola | H01Q 1/243 455/575.7 |

(Continued)

FOREIGN PATENT DOCUMENTS

| | | |
|---|---|---|
| JP | 2003-318640 | 11/2003 |

OTHER PUBLICATIONS

EESR—The Extended European Search Report dated Dec. 22, 2016 issued with respect to the corresponding European Patent Application No. 16175541.8.

*Primary Examiner* — Huedung Mancuso
(74) *Attorney, Agent, or Firm* — Fujitsu Patent Center

(57) ABSTRACT

An antenna apparatus includes a first ground plane; a second ground plane having first, second, third and fourth sides, a cutout part, and a slit having an open end; a first radiating element having first and second lines, and a feeding point; a second radiating element having a third line; and a parasitic element having first and second parasitic lines. A length from the feeding point to an end part of the slit is set to one-half wavelength at a first communication frequency, a total length of a length from an end part of the fourth line to the feeding point, and a length from a ground potential point to an end part of the second parasitic line is set to one-half wavelength at a second communication frequency, and a length of the third line and the fourth line is set to one-quarter wavelength at a third communication frequency.

8 Claims, 27 Drawing Sheets

(56) References Cited

U.S. PATENT DOCUMENTS

| | | | | |
|---|---|---|---|---|
| 2008/0180330 | A1 | 7/2008 | Wei-Shan et al. | |
| 2011/0001681 | A1* | 1/2011 | Hsu | H01Q 1/38 343/860 |
| 2013/0241786 | A1 | 9/2013 | Ko et al. | |
| 2014/0354505 | A1 | 12/2014 | Kwon | |

* cited by examiner

FIG.16A

| FREQUENCY [GHz] | ANTENNA | 10 g AVERAGE [W/kg] | REDUCTION RATE [%] |
|---|---|---|---|
| 0.9 | LOW SAR | 0.43 | 64.1 |
| 0.9 | MONOPOLE | 1.20 | |

FIG.16B

| FREQUENCY [GHz] | ANTENNA | 10 g AVERAGE [W/kg] | REDUCTION RATE [%] |
|---|---|---|---|
| 1.5 | LOW SAR | 1.63 | 42.6 |
| 1.5 | MONOPOLE | 2.84 | |

FIG.16C

| FREQUENCY [GHz] | ANTENNA | 10 g AVERAGE [W/kg] | REDUCTION RATE [%] |
|---|---|---|---|
| 2.0 | LOW SAR | 3.16 | 28.3 |
| 2.0 | MONOPOLE | 4.41 | |

FIG.16D

| FREQUENCY [GHz] | ANTENNA | 10 g AVERAGE [W/kg] | REDUCTION RATE [%] |
|---|---|---|---|
| 2.5 | LOW SAR | 4.18 | 17.2 |
| 2.5 | MONOPOLE | 5.05 | |

ANTENNA APPARATUS

CROSS-REFERENCE TO RELATED APPLICATION

This patent application is based upon, and claims the benefit of priority of Japanese Patent Application No. 2015-148145 filed on Jul. 27, 2015, the entire contents of which are incorporated herein by reference.

FIELD

The disclosures herein generally relate to an antenna apparatus.

BACKGROUND

A related art technology discloses a built-in multiband antenna including a feeding part composed of a feeding pin connected to an external circuit, and a feeding line having a predetermined length with one end thereof connected to the feeding pin, a radiating patch formed at a predetermined distance from the feeding part in space, and configured to induce current supplied from the feeding part having a part connected to the feeding part. The antenna further includes a short part having one end coupled to the radiating patch and the other end connected to ground (see Patent Document 1).

RELATED ART DOCUMENT

Patent Document

Patent Document 1: Japanese Laid-open Patent Publication No. 2003-318640

The related art built-in multiband antenna is designed to have the feeding line and the radiating patch disposed almost over the entire surface of the built-in multiband antenna; this configuration may limit the space of the built-in multiband antenna for managing further additional bands.

In particular, antenna apparatuses for use in electronic apparatuses such as tablet computers, smartphone terminals, and mobile phone terminals have limited space for incorporating the radiating elements. Hence, it appears to be difficult for such antenna apparatuses to increase the number of communications bands.

SUMMARY

According to an aspect of the embodiments, there is provided an antenna apparatus that includes a first ground plane; a second ground plane having a first side disposed along an edge, the first side having a first end and a second end, a second side and a third side disposed in a direction away from the edge in a plan view, the second side extending from the first end, the third side extending from the second end, a fourth side connecting the second side and the third side, a cutout part formed by removing a rectangular area along a fifth side from the fourth side at a position from the third side toward the second side, and a slit having an open end on the first end formed between the first ground plane and the second ground plane in a plan view, the slit being formed as a result of connecting the second end of the first side to the first ground plane; a first radiating element having a first line standing from a ground end with respect to the second ground plane, the first line being connected to the second ground plane near the first end of the first side, a second line connected to the first line, the second line extending toward the third side along the first side to an end part, the end part located opposite to the ground end, and a feeding point disposed at the end part of the second line; a second radiating element 120 having a third line connected to the end part of the second line of the first radiating element, the third line extending along the first side toward the third side, and a fourth line connected to the third line, the fourth line extending along the third side in a direction away from the first ground plane in a plan view; and a parasitic element having a first parasitic line extending from the second end along the third side inside the rectangular area, and a second parasitic line connected to the first parasitic line, the second parasitic line extending toward the second side along the fourth side inside the rectangular area. In the antenna apparatus, a length from the feeding point, via the first radiating element, the ground end, the second end, and the edge to the end part of the slit is set to a one-half wavelength long at a first communication frequency, a total length of a length from an end part of the fourth line of the second radiating element to the feeding point, and a length from a ground potential point corresponding to the feeding point of the second ground plane to an end part of the second parasitic line of the parasitic element is set to a one-half wavelength long at a second communication frequency higher than the first communication frequency, and a length of the third line and the fourth line of the second radiating element is set to a one-quarter wavelength long at a third communication frequency higher than the second communication frequency.

The object and advantages of the invention will be realized and attained by means of the elements and combinations particularly pointed out in the appended claims.

It is to be understood that both the foregoing general description and the following detailed description are exemplary and explanatory and are not restrictive of the invention.

Additional objects and advantages of the embodiments will be set forth in part in the description which follows, and in part will be obvious from the description, or may be learned by practice of the invention.

BRIEF DESCRIPTION OF THE DRAWINGS

FIGS. 16A to 16D are diagrams illustrating results of the simulation using the phantom 1;

DESCRIPTION OF EMBODIMENTS

The embodiments of the present invention may propose an antenna apparatus adaptable for multiple bands.

The following illustrates embodiments to which an antenna apparatus of the invention is applied.

First Embodiment

Figure 1:
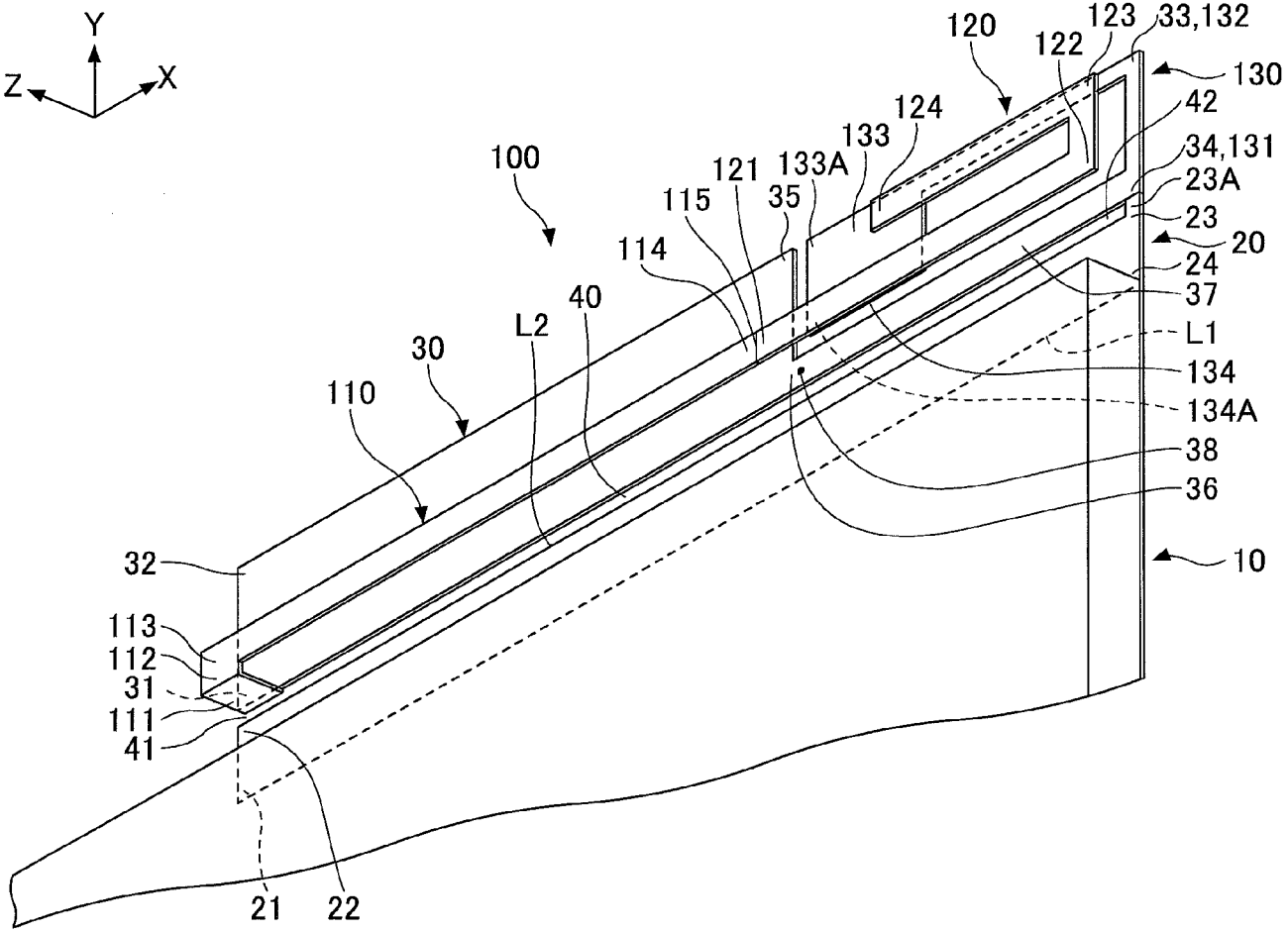
FIG. 1 is a diagram illustrating an internal configuration of an electronic apparatus including an antenna apparatus 100 according to a first embodiment.

FIG. 1 is a diagram illustrating an internal configuration of an electronic apparatus including an antenna apparatus 100 according to a first embodiment.

The antenna apparatus 100 includes a ground plane 20, a ground plane 30, a radiating element 110, a radiating element 120, and a parasitic element 130. The description given below employs an XYZ coordinate system of the Cartesian coordinates system.

The antenna apparatus 100 is attached to a metallic plate 10 included in a housing of portable electronic apparatuses such as tablet computers or smartphone terminal apparatuses.

The metallic plate 10 is thicker than the ground plane 20 and the ground plane 30, and is configured to be maintained at a ground potential. The metallic plate 10 may, for example, be a plate disposed at an opposite side of a display surface of a display panel of the electronic apparatus. The metallic plate 10 disposed in this case is aimed at reinforcing the display panel.

The metallic plate 10 may be connected to a central processing unit (CPU) chip, a memory, or to other electronic components necessary for implementing functions of the electronic apparatus. Note that the metallic plate 10 is not limited to the above-described configuration, and the metallic plate 10 may have any configuration insofar as the metallic plate 10 is included in the above-described electronic apparatus. The electronic apparatus may have no display panel.

The ground plane 20 is a metallic layer connected to a side L1 parallel to an X axis of the metallic plate 10, and is configured to be maintained at a ground potential. The ground plane 20 is a rectangular metallic layer having vertices 21, 22, 23, and 24.

The side L1 connecting the vertices 21 and 24, and a side L2 connecting the vertices 22 and 23 are both parallel to the X axis. A side connecting the vertices 21 and 22, and a side connecting the vertices 24 and 23 are both parallel to a Y axis. The side L2 is an opposite side of the side L1, and serves as an end-side of the ground plane 20. The ground plane 20 is projected from the vertex 23 toward the Y axis direction, and includes a connecting part 23A connected to a vertex 34 of the ground plane 30.

The ground plane 20 is an example of a first ground plane, and serves as a ground plane of the antenna apparatus 100. The ground plane 20 may be a plated layer formed on an internal surface of the housing of the portable electronic apparatus. The plated layer may, for example, be formed of copper plating or other metallic plating.

The ground plane 30 is an example of a second ground plane, and serves as a ground plane of the antenna apparatus 100. The ground plane 30 is a rectangular metallic layer having vertices 31, 32, 33, and 34, and forms the parasitic element 130 toward a positive X axis direction. The parasitic element 130 includes the vertex 33, and is formed within a rectangular area spreading in the X axis and the Y axis directions.

The ground plane 30 is thus shaped to have an additional line 37 extending toward the vertex 34 from a vertex 36 of a rectangular metallic layer having the vertices 31, 32, 35, and 36.

The ground plane 30 forms the parasitic element 130 by having an above-described internal rectangular area removed by patterning from the rectangular metallic layer having the vertices 31, 32, 33, and 34. Hence, the following illustration supposes that there are a side connecting the vertices 32 and 33, and a side connecting the vertices 33 and 34 for convenience.

The side connecting the vertices 31 and 34, and the side connecting the vertices 32 and 33 are both parallel to the X axis. The side connecting the vertices 31 and 32, and the side connecting the vertices 34 and 33 are both parallel to the Y axis. The side connecting the vertices 31 and 34 is parallel to the side L2.

The vertex 34 of the ground plane 30 is connected to the connecting part 23A of the ground plane 20. The vertex 31 is distant from the vertex 22. This indicates that a slit 40 is formed between the ground plane 30 and the ground plane 20.

The ground plane 30 thus approximately overlaps the radiating element 110 and the radiating element 120 in plan view. The ground plane 30 is disposed for reducing a specific absorption rate (SAR).

The ground plane 30 is thus designed to be arranged on a human body side of the electronic apparatus.

The function of the ground plane 30 may be implemented by metallic foil attached on a surface of a substrate formed of an insulator, for example. The metallic foil may be copper foil or other metallic foils. Note that the ground plane 30 and the ground plane 20 may be uniformly formed of one metallic foil, or the ground plane 30 may be formed of a plated layer, similar to the ground plane 20.

The slit 40 includes an end part 41 and an end part 42 that extend toward the X axis direction between the ground plane 20 and the ground plane 30. The end part 41 has an open end, and the end part 42 is closed by the connecting part 23A. Note that a length between the end part 41 and the end part 42 of the slit 40 will be described later.

The following describes the radiating element 110, the radiating element 120, and the parasitic element 130. The radiating element 110 and the radiating element 120 may be formed on a surface of dielectric, a substrate, or a housing disposed in a positive Z axis direction of the ground plane 30. Note that illustration of the dielectric, the substrate, or the housing is omitted from FIG. 1. For example, in a case where the antenna apparatus 100 is included in the portable electronic apparatus such as a tablet computer or a smartphone, the radiating element 110 and the radiating element 120 may be formed on the surface of the dielectric, the substrate included in the electronic apparatus, or the housing of the electronic apparatus disposed in the Z axis direction of the ground plane 30.

The radiating element 110 is disposed for implementing communications of the lowest communication frequency f1 of the three communications frequencies of the antenna apparatus 100. The design value of the communication frequency f1 may, for example, be 0.9 GHz. The radiating element 110 includes a ground end 111, bent parts 112 and 113, and an end part 114. The end part 114 of the radiating element 110 is provided with a feeding point 115.

The ground end 111 is connected to the vertex 31 of the ground plane 30. The ground end 111 is an example of a ground end. The radiating element 110 stands and extends from the ground end 111 in a positive Z axis direction, is bent at the bent part 112 in the positive Y axis direction, is further bent at the bent part 113 in the positive X axis direction, and extends to the end part 114. The end part 114 is connected to an end part 121 of the radiating element 120. The radiating element 110 is integrally formed with the radiating element 120.

Note that the end part 114 indicates an end part in the positive X axis direction of a part serving as the radiating element 110 integrally formed with a part serving as the radiating element 120. Hence, the end part 114 is not an end part in an integrally formed physical structure of the radiating element 110 and radiating element 120.

Note that a line between the ground end 111 and the bent part 112 is an example of a first line. Note that a line between the bent part 113 and the end part 114 is an example of a second line.

The line between the ground end 111 and the bent part 112 is a sheet-like line parallel to a XZ plane. An interval between the bent part 112 and the bent part 113 is a bent section formed by bending the sheet-like line between the ground end 111 and the bent part 112 parallel to the XZ plane to the sheet-like line parallel to an XY plane. The line between the ground end 113 and the bent part 114 is a sheet-like line parallel to the XY plane.

Note that a section parallel to the XY plane between the bent part 112 and the bent part 113 may further extend in the positive Y axis direction.

The feeding point 115 is located at a boundary between the end part 114 and the end part 121 of the radiating element 120. The end part 114 thus serves as a feeding point. The feeding point 115 may be electrically fed by using a not-illustrated micro-strip line or coaxial cable.

Further, a point in a negative Z axis direction of the feeding point 115 of the ground plane 30 serves as a ground potential point 38. The ground potential point 38 is located immediately beneath the feeding point 115. For example, in a case where a core wire of the coaxial cable is connected to the feeding point 115, a shielded line of the coaxial cable is connected to the ground potential point 38. The ground potential point 38 serves as a reference potential point.

Note that communications at a communication frequency f1 are not performed by the radiating element 110 alone, but are implemented by the radiating element 110 in collaboration with the ground planes 20 and 30 along the slit 40. The detailed illustration will be described later.

The radiating element 120 includes the end part 121, bent parts 122 and 123, and an open end 124. The radiating element 120 is disposed for implementing the highest communication frequency f3 and the second highest communication frequency f2 of the three communications frequencies included in the antenna apparatus 100. The radiating element 120 is an example of a second radiating element. The design value of the communication frequency f2 may, for example, be 1.5 GHz. The design value of the communication frequency f3 may, for example, be 2.2 GHz. The height of the radiating element 120 with respect to the ground plane 30 is equal to the height of the radiating element 110 with respect to the ground plane 30. The radiating element 120 stands and extends from the end part 121 in a positive Y axis direction, is bent at the bent part 122 in a negative X axis direction, is further bent at the bent part 123 in a negative Y axis direction, and extends to the open end 124. The radiating element 120 has a C-shape as described above.

The end part 121 is connected to the end part 114 of the radiating element 110. The boundary between the end part 121 and the end part 114 is provided with the feeding point 115. The end part 121 thus serves as a feeding point.

The radiating element 120 is integrally formed with the radiating element 110. The end part 121 indicates an end part in the negative X axis direction of a part serving as the radiating element 120 integrally formed with a part serving as the radiating element 110. Hence, the end part 121 is not an end part in an integrally formed physical structure of the radiating element 110 and radiating element 120.

The length from the end part 121 (feeding point 115) via the bent parts 122 and 123 to the open end 124 is set to one-quarter (¼) of the wavelength $\lambda_3$,i.e., one-quarter wavelength long, at the communication frequency f3. The radiating element 120 thus functions as a monopole antenna.

Note that a line between the end part 121 and the bent part 122 is an example of a third line. A line between the bent part 122 and the bent part 123 is an example of a fourth line. A line between the bent part 123 and the open end 124 is an example of a fifth line. A line between the bent part 123 and the open end 124 may be identified as a line corresponding to an extended section of the fourth line.

Note that in a case where the radiating element 120 is able to secure a $\lambda_3/4$ length without having a section from the bent part 123 to the open end 124, the radiating element 120 may not include the section from the bent part 123 to the open end 124. In this case, the bent part 123 becomes an open end.

The parasitic element 130 is formed by patterning (removing) a metal film within a rectangular area including the vertex (apex) 33 of the ground plane 30. The rectangular area is composed of the vertices 33, 34, 35, and 36. Note that the "parasitic" indicates "having no feeding point".

The parasitic element 130 includes an end part 131, bent parts 132 and 133, and an open end 134. The end part 131 is located at the same position as the vertex 34 of the ground plane 30, and the bent part 132 is located at the same position as the vertex 33 of the ground plane 30.

The parasitic element 130 has a C-shape as described above. The section between the bent part 133 and the open end 134 is wider in the line width than the section between the end part 131 and the bent part 132, and is also wider in the line width than the section between the bent part 132 and the bent part 133. Note that the section between the bent part 133 and the open end 134 is formed to have wider line widths in order to expand the bandwidths.

The parasitic element 130 is disposed for implementing communications of the second highest communication frequency f2 of the three communications frequencies of the antenna apparatus 100. The parasitic element 130 implements communications at the communication frequency f2 in collaboration with the radiating element 120.

The parasitic element 130 stands and extends from the end part 131 in the positive Y axis direction, is bent at the bent part 132 in the negative X axis direction, is further bent at the bent part 133 in the negative Y axis direction, and extends to an open end 134.

A total length of the parasitic element 130, the line 37, and the radiating element 120 obtained via the feeding point 115 and the ground potential point 38 is set to one-half (½) wavelength of the wavelength $\lambda_2$ at the communication frequency f2. The parasitic element 130, the line 37, and the radiating element 120 thus function as a dipole antenna. The dipole antenna composed of the parasitic element 130, the line 37, and the radiating element 120 has the feeding point 115 and the ground potential point 38 disposed at offset positions with respect to the center of a length $\lambda_2/2$.

The end part 133A in the negative X axis direction of the bent part 133 is located near the vertex 35 of the ground plane 30, and is located on a side connecting the vertex 32 and the vertex 33. The end part 134A in the negative X axis direction of the opening end 134 is located near the vertex 36.

Note that a line between the end part 131 and the bent part 132 is an example of a first parasitic line. A line between the bent part 132 and the bent part 133 is an example of a second parasitic line. A line between the bent part 133 and the open end 134 is an example of a third parasitic line. Further, a line between the bent part 133 and the open end 134 may be identified as a line of an extended section of the second parasitic line.

In a case where the parasitic element 130 is able to implement a dipole antenna having the length $\lambda_2/2$ without having a section from the bent part 133 to the open end 134, the parasitic element 130 may not include the section from the bent part 133 to the open end 134. In this case, the bent part 133 becomes an open end.

The parasitic element 130 has a C-shape along the radiating element 120 in plan view. The parasitic element 130 has such a C-shape to electromagnetically couple the parasitic element 130 and the radiating element 120 to allow the parasitic element 130 to receive electric feed via the radiating element 120.

The line between the end part 131 and the bent part 132 is thus disposed along the line between the end part 121 and the bent part 122 in plan view. A line between the bent part 132 and the bent part 133 is disposed along the line between the bent part 122 and the bent part 123. A line between the bent part 132 and the open end 134 is disposed along the line between the bent part 123 and the open end 124.

In order for the above-described antenna apparatus 100 to implement the communications at the communication frequency f1, the length of a path from the feeding point 115 to the vertex 22 via the ground end 111, the vertex 34 of the ground plane 30, the connecting part 23A, and the vertex 23 is set to one-half (½) wavelength ($\lambda_1/2$ wavelength) of the wavelength $\lambda_1$ at the communication frequency f1. The length of the path from the feeding point 115 to the vertex 22 includes a length of the side L2 of the ground plane 20.

More specifically, the above-described path passes through the bent part 113 and the bent part 112 between the feeding point 115 and the ground end 111. The path passes through the vertex 31 and the vertex 34 of the ground plane 30 near the slit 40 between the ground end 111 and the connecting part 23A. The path passes through the vertex 23 of the ground plane 20 near the slit 40 along the side L2 reaching the vertex 22 between the connecting part 23A and the vertex 22. The length of the path between the feeding point 115 and the vertex is set to one-half (½) wavelength ($\lambda_1/2$ wavelength) of the wavelength $\lambda_1$ at the communication frequency f1.

An electromagnetic field simulation result indicates that such an electric current path has generated a resonance communication frequency f1. That is, the antenna apparatus 100 implements communications at the communication frequency f1 by the radiating element 110 collaborating with the ground plane 20 and the ground plane 30 along the slit 40.

In the antenna apparatus 100 of the embodiment, the length of the path from the feeding point 115 via the ground end 111, the ground plane 30, and the connecting part 23A to the vertex 22 is set to one-half (½) wavelength ($\lambda_1/2$ wavelength) of the wavelength $\lambda_1$ at the communication frequency f1.

Figure 2:
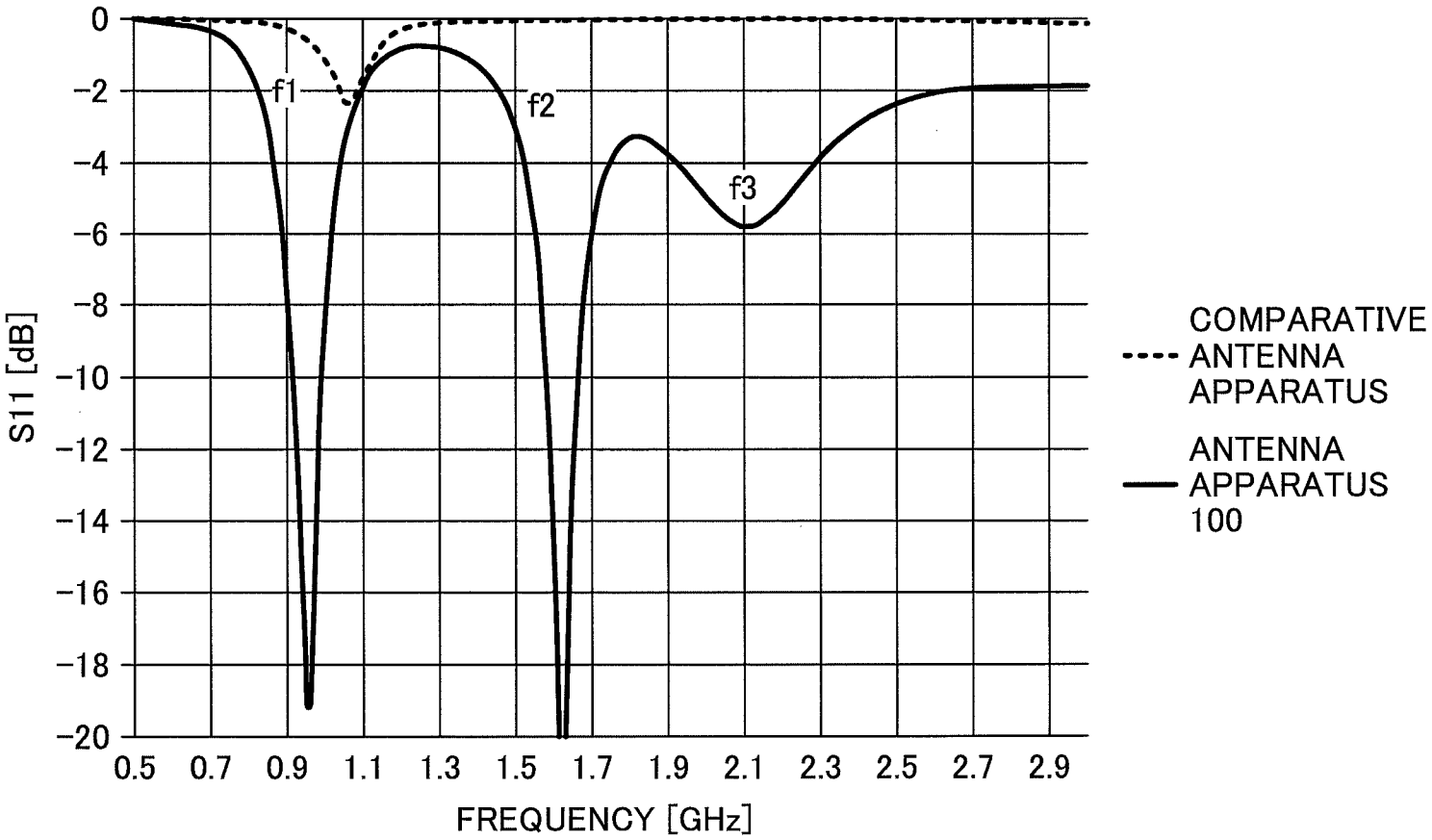
FIG. 2 is a graph illustrating frequency characteristics of S11-parameters of the antenna apparatus 100.

FIG. 2 is a graph illustrating frequency characteristics of S11-parameters of the antenna apparatus 100. The frequency characteristics of the S11-parameters are obtained by the electromagnetic field simulation using the antenna apparatus 100 as a model. The electromagnetic field simulation was performed without disposing a matching circuit between the feeding point 115 and the ground plane 30.

In this case, an evaluation standard for a value of the S11-parameters is determined to be −5 dB as an example. S11-parameters are evaluated based on the bandwidths of −5 dB or lower falling within a communications capable area of the antenna apparatus 100.

As illustrated in FIG. 2, −5 dB or lower value is obtained in the following three bandwidths; that is, the bandwidth of approximately 0.85 GHz to 1.05 GHz (f1), the bandwidth of approximately 1.55 GHz to 1.70 GHz (f2), and the bandwidth of approximately 2.0 GHz to 2.2 GHz (f3). Note that FIG. 2 also illustrates values of the S11-parameters of a comparative antenna apparatus without having the radiating element 120 and the parasitic element 130.

The antenna apparatus 100 is composed of the comparative antenna apparatus, and additional radiating element 120 and parasitic element 130. This configuration of the antenna apparatus 100 has improved values of S11-parameters at the three communications frequencies f1, f2, and f3.

The antenna apparatus 100 is thus able to perform communications at the three communications frequencies (resonance frequencies) f1, f2, and f3.

Thus, according to the first embodiment, there may be provided the antenna apparatus 100 having the SAR countermeasures ground plane 30 and capable of performing communications at the three communications bandwidths (three bands) without increasing the antenna size.

According to the first embodiment, there may be provided the antenna apparatus 100 suitable for multiband communications.

Note that in the first embodiment, an illustration is given of the antenna apparatus 100 having the ground plane 20 and the ground plane 30 that have equal lengths in the X axis direction, and the two ends of the ground plane 20 and those of the ground plane 30 are located at the same positions. However, the configuration of the antenna apparatus 100 is not limited to this example. The antenna apparatus 100 may have the ground plane 30 having the length in the X axis direction longer than the length in the X axis direction of the ground plane 20, and the end part in the negative X axis direction of the ground plane 30 may be located further toward the negative X axis direction compared to the end part in the negative X axis direction of the ground plane 20. Further, the antenna apparatus 100 may have the ground plane 30 having the length in the X axis direction longer than the length in the X axis direction of the ground plane 20, and the end part in the positive X axis direction of the ground plane 30 may be located further toward the positive X axis direction compared to the end part in the positive X axis direction of the ground plane 20. Moreover, the antenna apparatus 100 may have the ground plane 30 having the length in the X axis direction longer than the length in the X axis direction of the ground plane 20, and the two ends in the X axis direction of the ground plane 30 may be located outer side from the two ends in the X axis direction of the ground plane 20.

Second Embodiment

Figure 3:
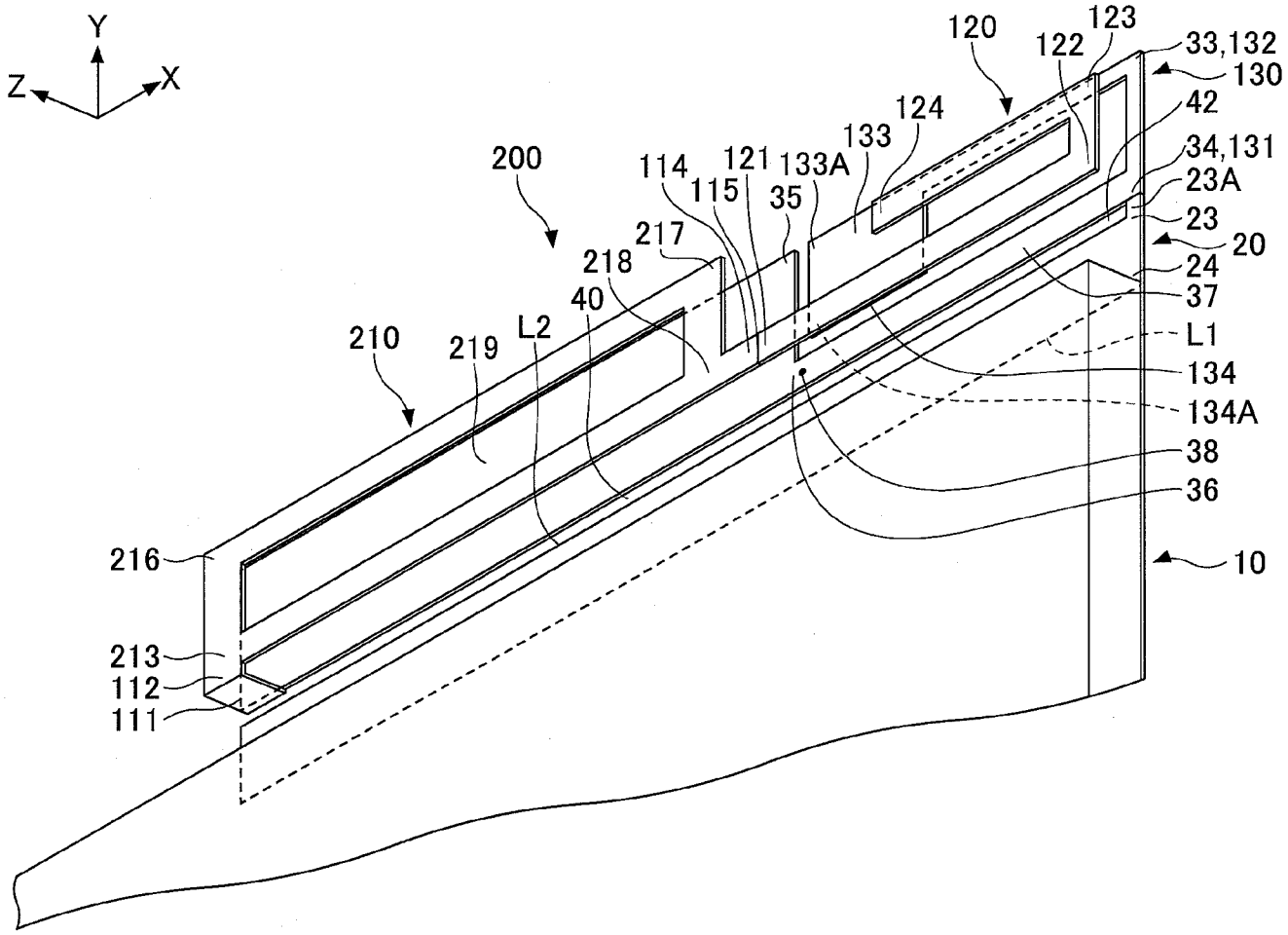
FIG. 3 is a diagram illustrating an internal configuration of an electronic apparatus including an antenna apparatus 200 according to a second embodiment.

FIG. 3 is a diagram illustrating an internal configuration of an electronic apparatus including an antenna apparatus 200 according to a second embodiment.

The antenna apparatus 200 includes a ground plane 20, a ground plane 30, a radiating element 210, a radiating element 120, and a parasitic element 130.

The antenna apparatus 200 of the second embodiment is formed by replacing the radiating element 110 of the antenna apparatus 100 of the first embodiment with the radiating element 210, which enables the antenna apparatus 200 to perform communications at four communications frequencies. The following mainly illustrates the difference between the antenna apparatus 100 of the first embodiment and the antenna apparatus 200 of the second embodiment, and omits a duplicated illustration by providing the same components with the same reference numbers. Note that a description given below employs an XYZ coordinate system of the Cartesian coordinates system in a manner similar to the first embodiment.

The radiating element 210 is disposed for implementing communications of the lowest communication frequency f1 of the three communications frequencies of the antenna apparatus 200. The radiating element 210 includes a ground end 111, a bent part 112, a branching part 213, an end part 114, bent parts 216 and 217, and a branching part 218. The radiating element 210 includes a slot 219 enclosed by a line connecting the branching part 213, the bent parts 216 and 217, and the branching part 218. The radiating element 210 further includes a feeding point 115.

The ground end 111, the bent part 112, the end part 114, and the feeding point 115 of the radiating element 210 of the second embodiment are similar to the ground end 111, the bent part 112, the end part 114, and the feeding point 115 of the radiating element 110 of the first embodiment.

The radiating element 210 stands and extends from the ground end 111 in a positive Z axis direction, is bent at the bent part 112 in a positive Y axis direction, is split into the positive X axis direction and the positive Y axis direction at the branching part 213. The radiating element 210 extends from the branching part 213 in the positive X axis direction to the end part 114. The end part 114 is connected to an end part 121 of the radiating element 120. The radiating element 210 is integrally formed with the radiating element 120.

Note that the end part 114 indicates an end part in the X axis direction of a part serving as the radiating element 210 integrally formed with a part serving as the radiating element 120. Hence, the end part 114 is not an end part in an integrally formed physical structure of the radiating element 210 and radiating element 120.

The radiating element 210 extends from the branching part 213 in the positive Y axis direction, is bent at the bent part 216 in the positive X axis direction, extends in the positive X axis direction, is bent at the 217 in the negative Y axis direction, and extends to the branching part 218. The radiating element 210 as viewed from the negative X axis direction splits into two directions at the branching part 218; that is, the negative X axis direction and the positive Y axis direction. The branching part 218 is located close to the end part 114.

Note that a line between the ground end 111 and the bent part 112 is an example of a first line. Note that a line between the branching part 213 and the end part 114 is an example of a second line. The second line splits into two lines, namely, a line extending from the branching part 213 in the positive X axis direction and a line extending from the branching part 213 via the bent parts 216 and 217, and the branching part 218. The slot 219 extending in the X axis direction is formed in the middle of the second line.

The line between the ground end 111 and the bent part 112 is a sheet-like line parallel to a XZ plane. The line between the bent part 112 and the branching part 213 is a sheet-like line parallel to an XY plane. The line between the branching part 213 and the end part 114 is a sheet-like line parallel to the XY plane.

Note that a section parallel to the XY plane between the bent part 112 and the branching part 213 may further extend in the positive Y axis direction.

The feeding point 115 is located at a boundary between the end part 114 and the end part 121 of the radiating element 120.

Note that communications at a communication frequency f1 is not performed by the radiating element 210 alone, but is implemented by the radiating element 210 in collaboration with the ground planes 20 and 30 along the slit 40. The detailed illustration will be described later.

The antenna apparatus 200 may implement the communications frequencies f1 to f3 by the following path in a manner similar to the antenna apparatus 100 of the first embodiment.

In order for the above-described antenna apparatus 200 to implement the communications at the communication frequency f1, the length from the feeding point 115, via the ground end 111, the vertex 34 of the ground plane 30, the connecting part 23A, the vertex 23 of the ground plane 20 along the side L2 to the vertex 22 is set to one-half (½) wavelength ($\lambda_1/2$ wavelength) of the wavelength $\lambda_1$ at the communication frequency f1.

The length of the parasitic element 130 and the radiating element 120 via the feeding point 115 and the ground potential point 38 is set to one-half (½) wavelength of the wavelength $\lambda_2$ at the communication frequency f2. The parasitic element 130, the line 37, and the radiating element 120 thus function as a dipole antenna. The dipole antenna composed of the parasitic element 130, the line 37, and the radiating element 120 has the feeding point 115 and the ground potential point 38 having positions deviated from the center of a length $\lambda_2/2$.

The length from the end part 121 (feeding point 115) of the radiating element 120 via the bent parts 122 and 123 to the open end 124 is set to one-quarter (¼) wavelength of the wavelength $\lambda_3$ at the communication frequency f3. The radiating element 120 thus functions as a monopole antenna.

The fourth communication frequency f4 is implemented by a path from the open end 124 of the radiating element 120, via the radiating element 120, the radiating element 210, the ground end 111, and the vertex 31 to the vertex 34 of the ground plane 30.

More specifically, the path of the communication frequency f4 starts from the open end 124 of the radiating element 120, via the end part 121 to the end part 114 of the radiating element 210, the branching part 218, the bent parts 216 and 217 of the radiating element 210, the bent part 112, the ground end 111, and the vertex 31 to the vertex 34 of the ground plane 30.

The length of the path is set to five-quarters (5/4) wavelength of the wavelength $\lambda_4$ at the communication frequency f4.

A $5\lambda_4/4$ antenna is formed in a section from the open end 124 of the radiating element 120 to the vertex 34 of the ground plane 30 via the radiating element 120, the radiating element 210, the ground end 111, and the vertex 31. The $5\lambda_4/4$ antenna performs communications at a fifth-order harmonic frequency of the communication frequency f4.

The communication frequency f4 is higher than the communication frequency f3. The design value of the communication frequency f4 may, for example, be 2.5 GHz.

The path between the branching part 218 and the branching part 213 does not directly extend from the branching part 218 in the negative X axis direction to the branching part 213 but extends from the branching part 218 via the bent parts 216 and 217 to the branching part 213. Since the path extending from the branching part 218 via the bent parts 216 and 217 to the branching part 21 has more detours, the radiating element 210 may be formed to be compact.

Note that the slot 219 does not function as a slot antenna. The radiating element 210 that does not include the slot 219 between the branching part 213 and the branching part 218 still acquires the similar communication frequency f4. The radiating element 210 may increase a harmonic electric current exhibiting five times greater than the communication frequency f4 of that of the radiating element 110 of the first embodiment.

Alternatively, two or more slots 219 may be formed in the X axis direction. That is, the slot 219 may be divided into two or more slots in the X axis direction.

FIGS. 4 to 7 are diagrams illustrating dimensions of the antenna apparatus 200. The dimensions noted below indicate those for an example of the antenna apparatus 200 where the communications frequencies f1, f2, f3, and f4 are 0.9 GHz (f1), 1.5 GHz (f2), 2.2 GHz (f3), and 2.5 GHz (f4).

Note that FIGS. 4 to 7 employ an XYZ coordinate system the same as the XYZ coordinate system of FIG. 1. FIGS. 4 to 7 do not provide all the reference numbers but only provide main reference numbers for facilitating viewability.

Figure 4:
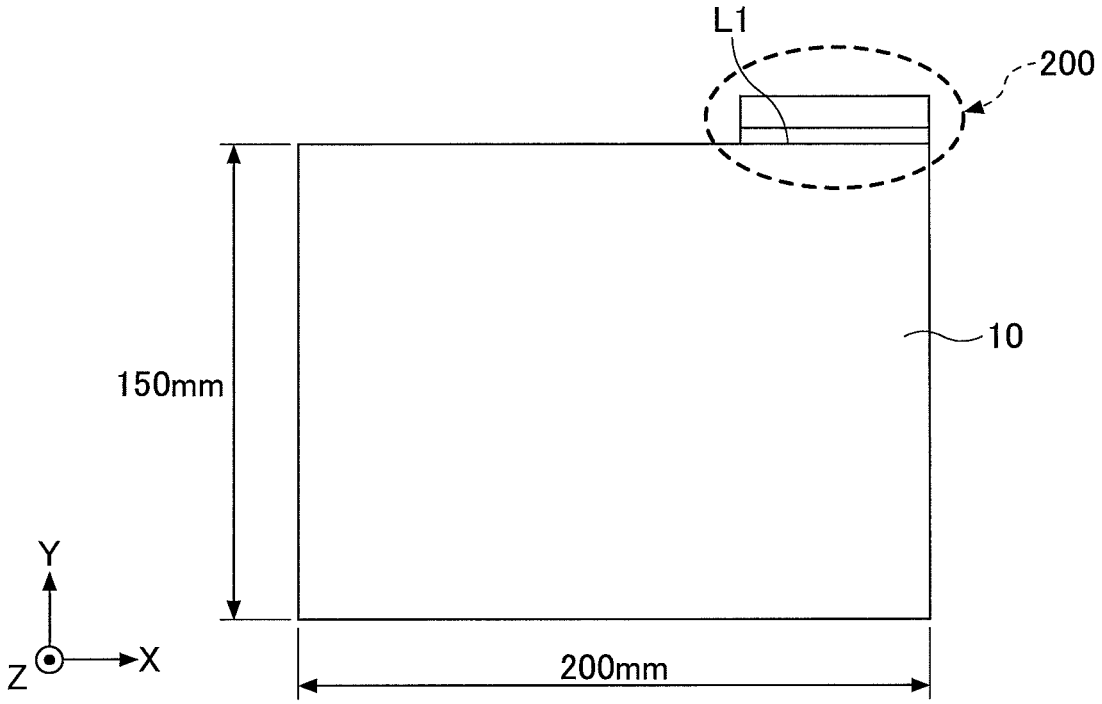
FIG. 4 is a diagram illustrating dimensions of parts in the antenna apparatus 200.

FIG. 4 illustrates a metallic plate 10 having a length in the X axis direction of 200 mm and a length in the Y axis direction of 150 mm. The length (the thickness) in the Z axis direction of the metallic plate 10 is 5 mm. The metallic plate 10 is a rectangular plate in a XY plan view, as illustrated in FIG. 4.

The antenna apparatus 200 is disposed in the positive X axis direction of the metallic plate 10 and at a corner in the positive Y axis direction of the metallic plate 10.

Figure 5:
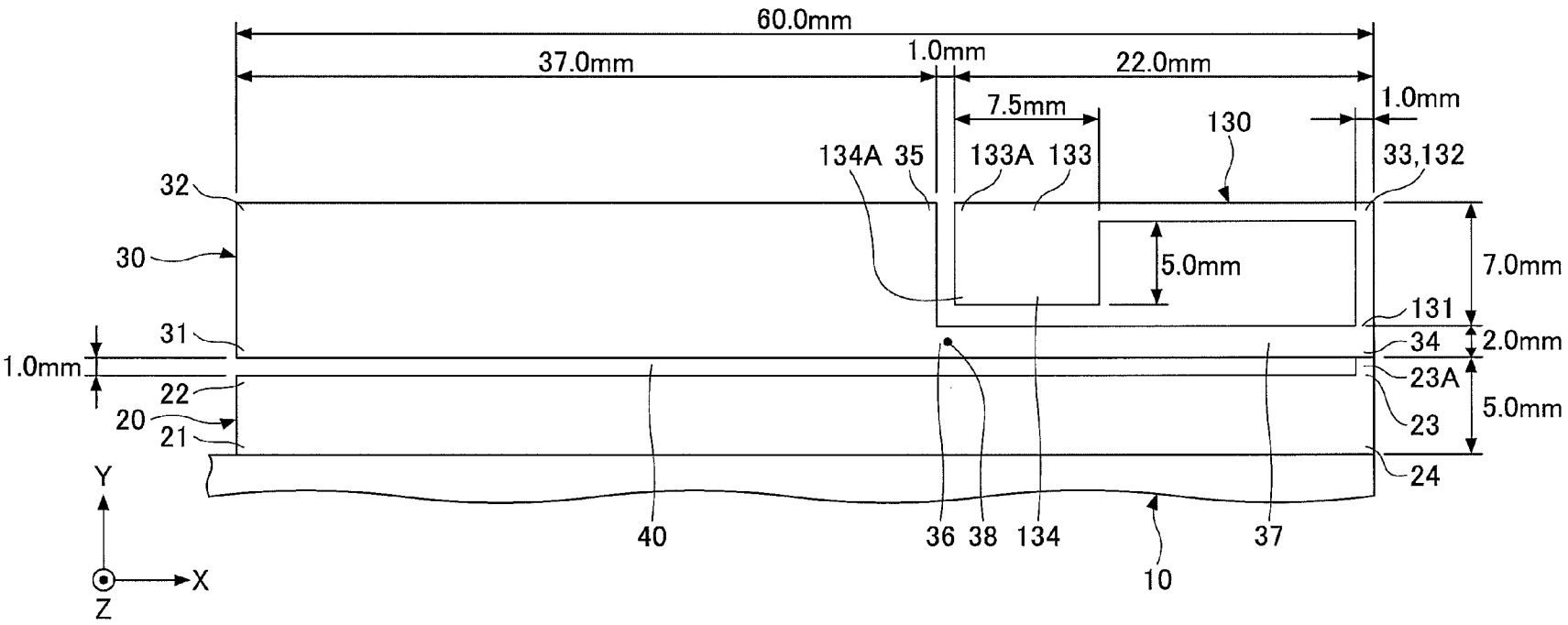
FIG. 5 is a diagram illustrating dimensions of parts in the antenna apparatus 200.

As illustrated in FIG. 5, the lengths of the ground plane 20 and the ground plane 30 are 60 mm. The length between the vertex 21 and the vertex 22 is 4.0 mm, and the length between the connecting part 23A and the vertex 24 is 5.0 mm.

The length between the vertex 32 and the vertex 35 is 37.0 mm, the length between the vertex 33 and the vertex 34 is 7.0 mm, the length between the vertex 33 and the end part 133A is 22.0 mm, and the length in the Y axis direction between the bent part 133 and the open end 134 is 6.0 mm. The width of the line in X axis direction between the bent part 133 and the open end 134 is 7.5 mm, and the width of the line 37 is 2.0 mm.

The line width of an L-shaped line from the end part 131 of the parasitic element 130 via the bent part 132 up to the bent part 133 is 1.0 mm. Further, a gap in the X axis direction between the vertex 35 and the end part 133A is 1.0 mm, the width in the Y axis direction of the slit 40 is 1.0 mm, the length in the X axis direction of the slit 40 is 59 mm.

Figure 6:
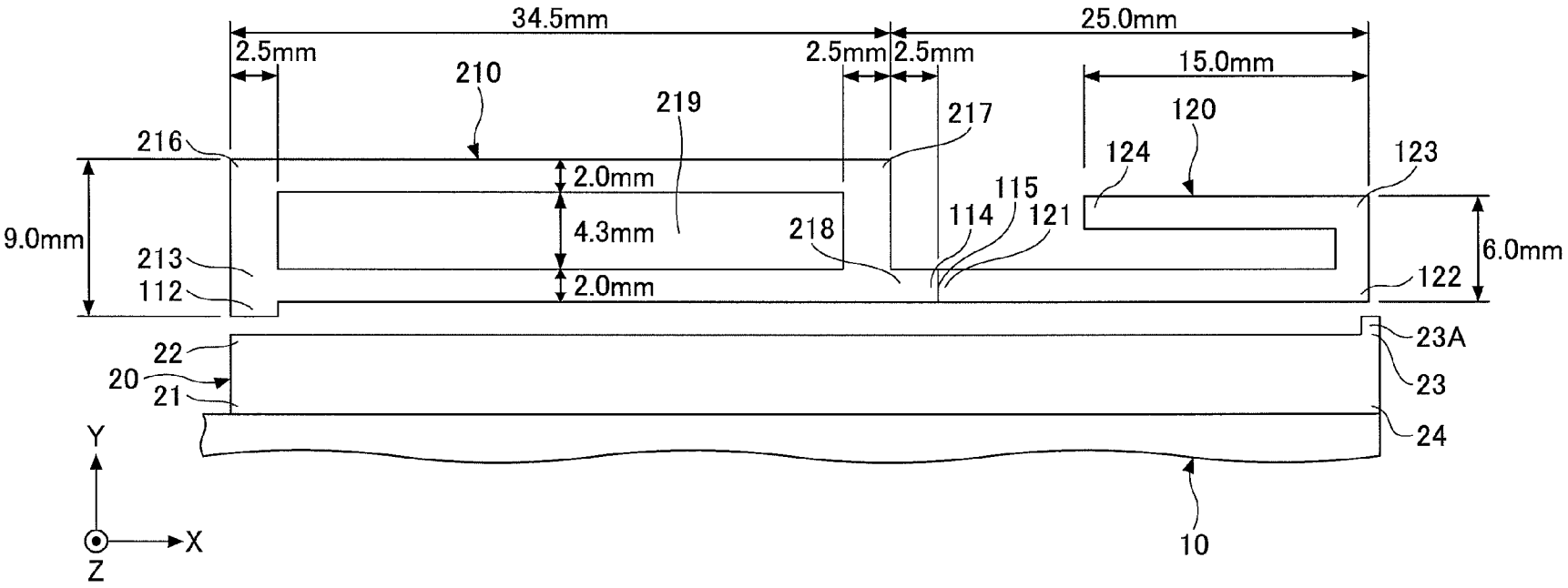
FIG. 6 is a diagram illustrating dimensions of parts in the antenna apparatus 200.

As illustrated in FIG. 6, the length of the line between the bent part 112 and the branching part 213 is 0.7 mm, the length of the line between the bent part 112 and the bent part 216 is 9.0 mm, and the width of the line between the bent part 112 and the bent part 216 is 2.5 mm.

The length of the line between the branching part 213 and the branching part 218 is 34.5 mm, the width of the line between the branching part 213 and the branching part 218 is 2.0 mm, the width of the line between the bent part 216 and the bent part 217 is 2.0 mm, and the width in the Y axis direction of the slot 219 is 4.3 mm.

The length of the line between the branching part 218 and the end part 114 is 2.5 mm, the length of the line between the branching part 218 and the bent part 122 is 25.0 mm, length of the line between the bent part 122 and the bent part 123 is 6.0 mm, and length of the line between the bent part 123 and the open end 124 is 15.0 mm.

Figure 7:
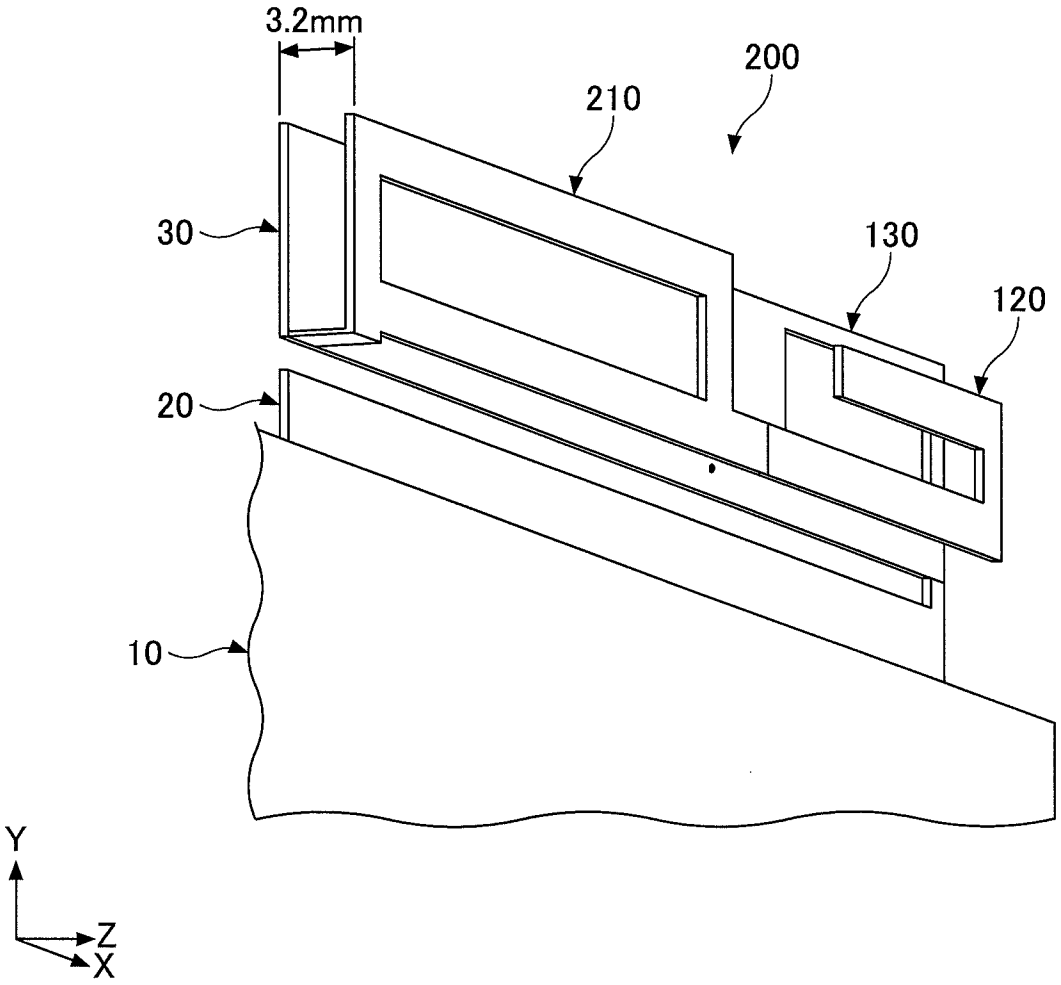
FIG. 7 is a diagram illustrating dimensions of parts in the antenna apparatus 200.

As illustrated in FIG. 7, a gap in the Z axis direction between the radiating element 210 and the ground plane 30 is 3.2 mm.

As described above, it may be effective to bend a tip of the radiating element 120 from the bent part 123 toward the open end 124 within a limited space having 60 mm in the X axis direction and 9 mm in the Y axis direction as a size of the ground plane 30. Further, it may also be effect to bend a tip of the parasitic element 130 from the bent part 133 toward the open end 134.

Figure 8:
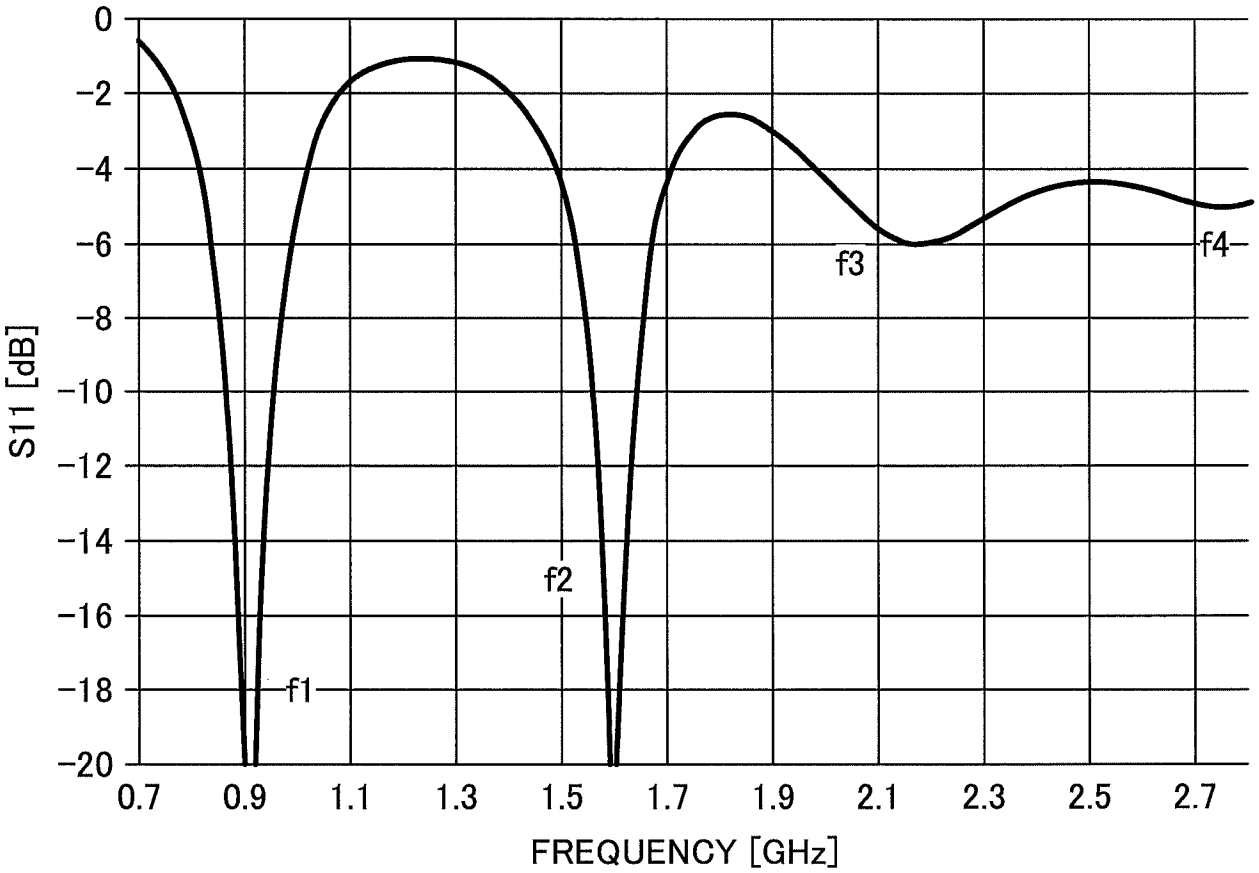
FIG. 8 is a graph illustrating frequency characteristics of S11-parameters of the antenna apparatus 200.

FIG. 8 is a graph illustrating frequency characteristics of S11-parameters of the antenna apparatus 200. The frequency characteristics of the S11-parameters are obtained by the electromagnetic field simulation using the antenna apparatus 200 as a model. The electromagnetic field simulation was performed without disposing a matching circuit between the feeding point 115 and the ground plane 30.

In this case, an evaluation standard for a value of the S11-parameters is determined to be −5 dB as an example. S11-parameters are evaluated based on the bandwidths of −5 dB or lower falling within a communications capable area of the antenna apparatus 200.

As illustrated in FIG. 8, −5 dB or lower value is obtained in the following four bandwidths; that is, the bandwidth of approximately 0.85 GHz to 1.05 GHz (f1), the bandwidth of approximately 1.55 GHz to 1.70 GHz (f2), the bandwidth of approximately 2.0 GHz to 2.2 GHz (f3), and the bandwidth of approximately 2.6 GHz to 2.8 GHz (f4).

Figure 9:
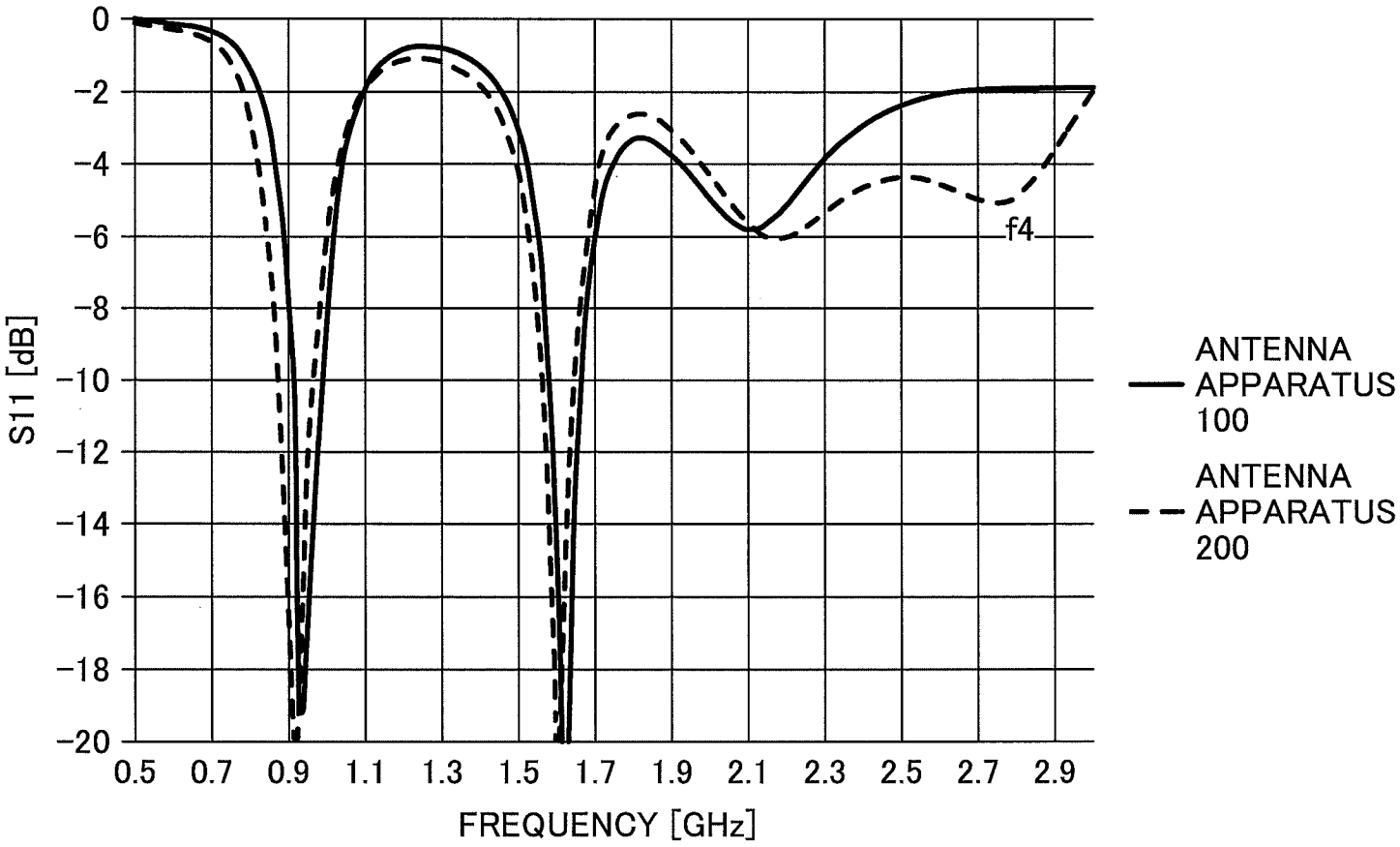
FIG. 9 is a graph comparing the frequency characteristics of the S11-parameters of the antenna apparatus 200 and the frequency characteristics of the S11-parameters of the antenna apparatus 100 of the first embodiment.

FIG. 9 is a graph comparing frequency characteristics of the S11-parameters of the antenna apparatus 200 and frequency characteristics of the S11-parameters of the antenna apparatus 100 of the first embodiment.

FIG. 9 indicates that the antenna apparatus 200 has acquired approximately 2.6 to 2.8 GHz (f4) because the antenna apparatus 200 has obtained lower values of the S11-parameters at a bandwidth of approximately 2.1 GHz or more compared to the antenna apparatus 100 of the first embodiment.

Figure 10:
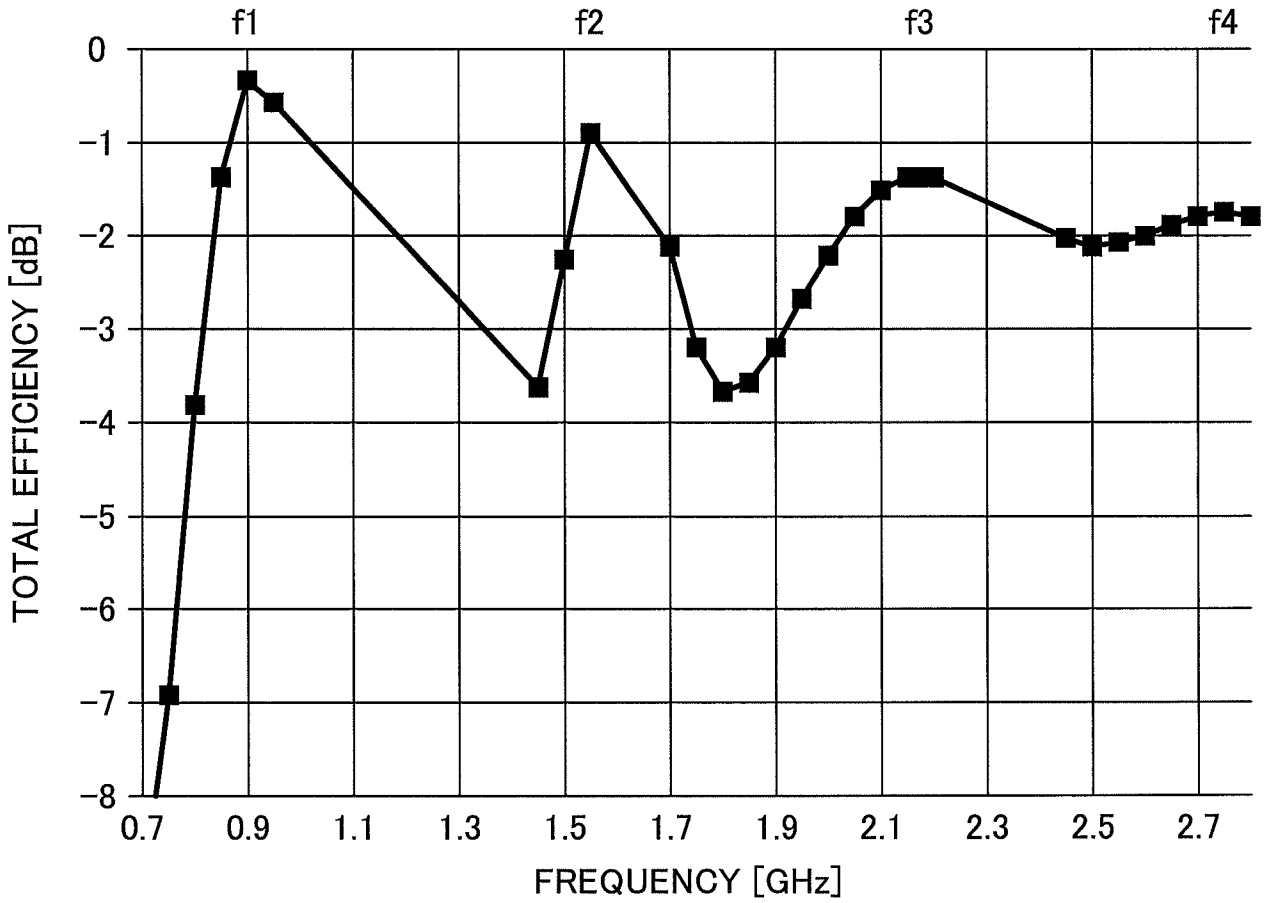
FIG. 10 is a diagram illustrating frequency characteristics of total efficiency of the antenna apparatus 200.

FIG. 10 is a graph illustrating frequency characteristics of total efficiency of the antenna apparatus 200. The total efficiency represents characteristics of the electronic apparatus to which the antenna apparatus 200 is attached, and includes matching loss with impedance of the feeding point 115 and the antenna apparatus 200.

As illustrated in FIG. 10, the total efficiency achieves respective peaks at the resonance frequencies f1, f2, f3, and f4, which indicates the antenna apparatus 200 being capable of performing the communications at the resonance frequencies f1, f2, f3, and f4.

FIGS. 11A to 14B are diagrams illustrating current paths of the radiating element 210, the radiating element 120, and the parasitic element 130. FIGS. 11A to 14B illustrate the radiating element 210, the radiating element 120, the parasitic element 130, and the ground planes 20 and 30 similar to those illustrated in FIGS. 5 and 6.

The following illustrates the current paths acquired by the electromagnetic field simulation. The communications frequencies f1, f2, f3, and f4 are set at 0.9, 1.6, 2.2, and 2.5 GHz, respectively.

Figure 11A:
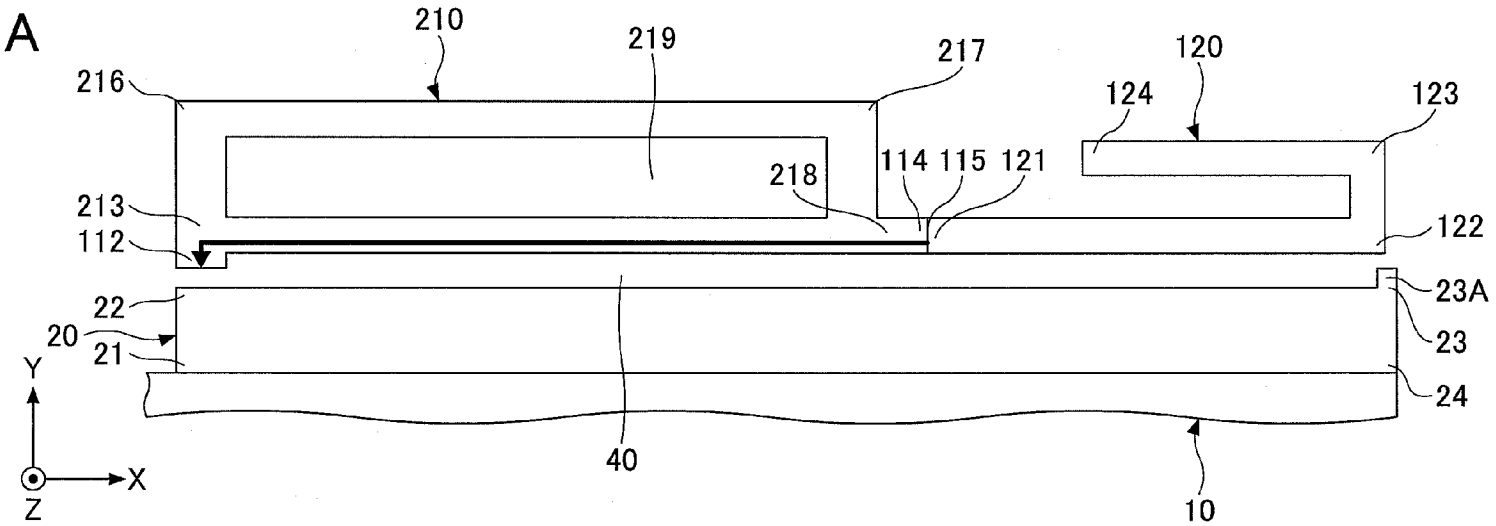
FIGS. 11A to 11B are diagrams illustrating current paths of the radiating element 210, the radiating element 120, and the parasitic element 130.
Figure 11B:
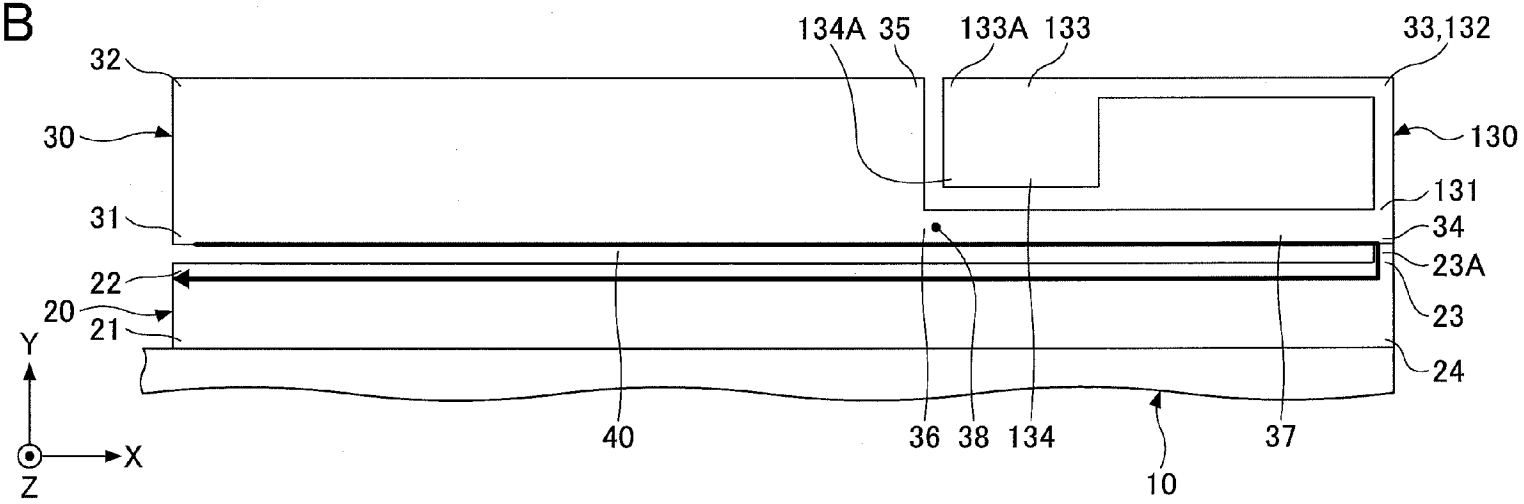

In the communications at the communication frequency f1 (0.9 GHz) using the radiating element 210, current flows from the feeding point 115, via the radiating element 210, the ground end 111, the ground plane 30, and the connecting part 23A to the vertex 22, as illustrated with bold solid arrows in FIGS. 11A and 11B.

The antenna apparatus 200 of the second embodiment has thus acquired a current path for the communication frequency f1 from the feeding point 115, via the radiating element 210, the ground end 111, the ground plane 30, and the connecting part 23A to the vertex 22.

A length of the path from the feeding point 115 to the vertex 22 via the radiating element 210, the ground end 111, the ground plane 30, and the connecting part 23A is set to one-half wavelength ($\lambda_1/2$) of the wavelength $\lambda_1$ at the communication frequency f1.

Figure 12A:
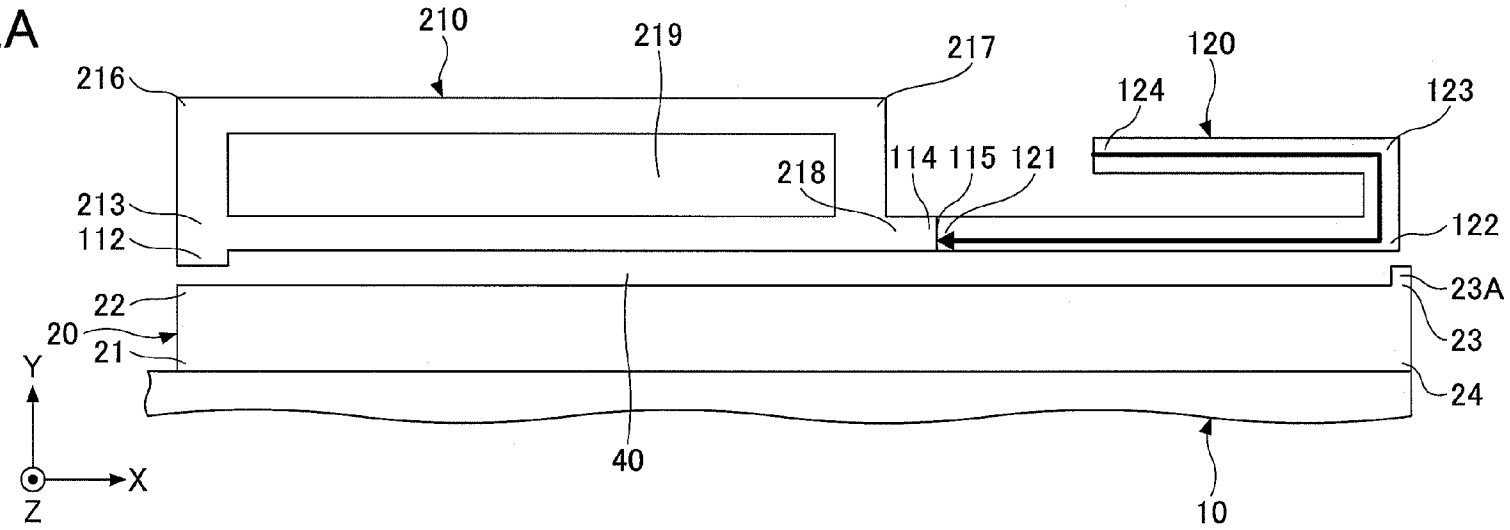
FIGS. 12A to 12B are diagrams illustrating current paths of the radiating element 210, the radiating element 120, and the parasitic element 130.
Figure 12B:
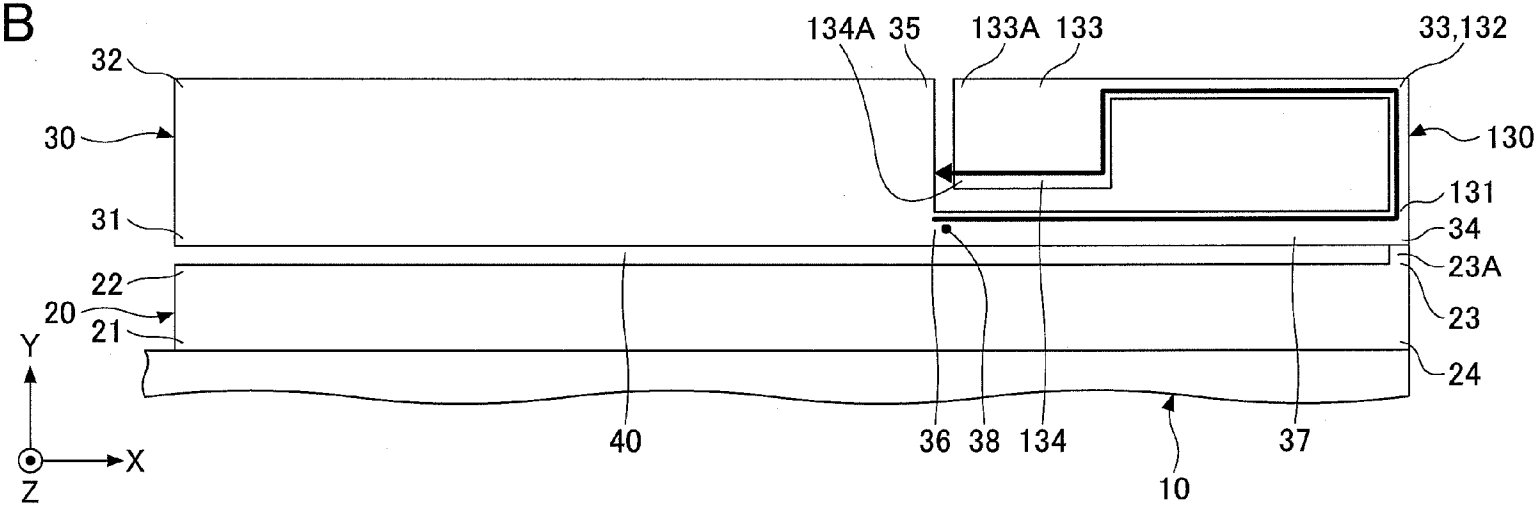

In the communications at the communication frequency f2 (1.6 GHz), a current path has acquired by the line between the end part 121 and the open end 124 of the radiating element 120, and the line from the vertex 36, via the line 37 to the end part 134A of the parasitic element 130, as illustrated with bold solid arrows in FIGS. 12A and 12B.

This result indicates that the radiating element 120, the line 37, and the parasitic element 130 serve as a dipole antenna at the communication frequency f2 (1.6 GHz).

Figure 13A:
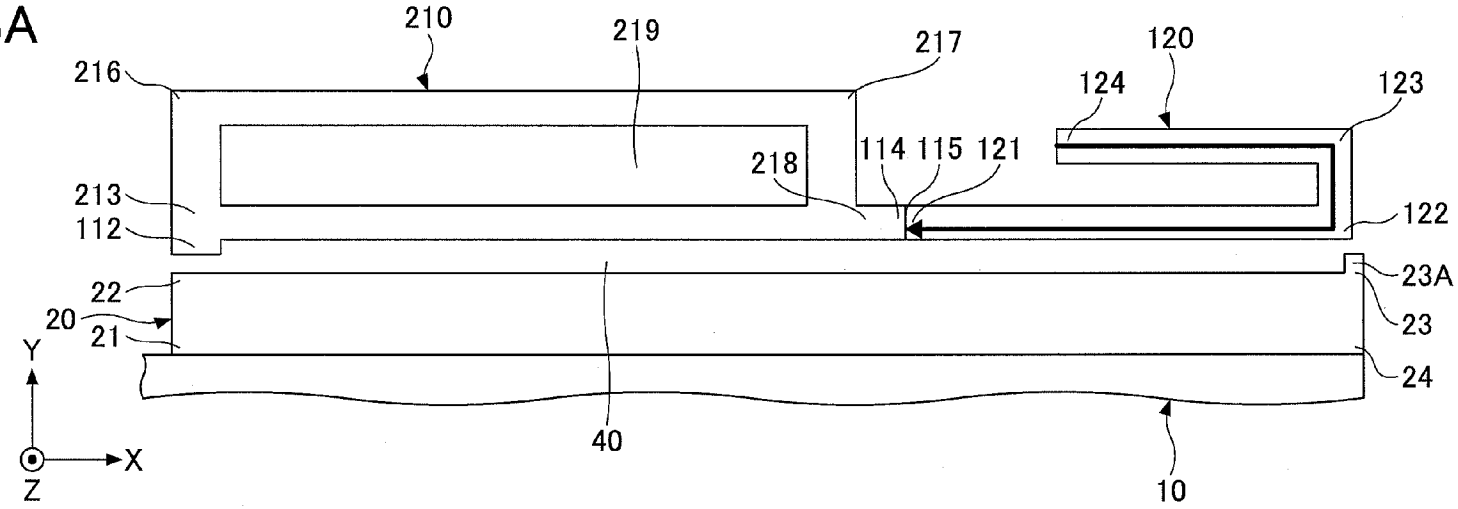
FIGS. 13A to 13B are diagrams illustrating current paths of the radiating element 210, the radiating element 120, and the parasitic element 130.
Figure 13B:
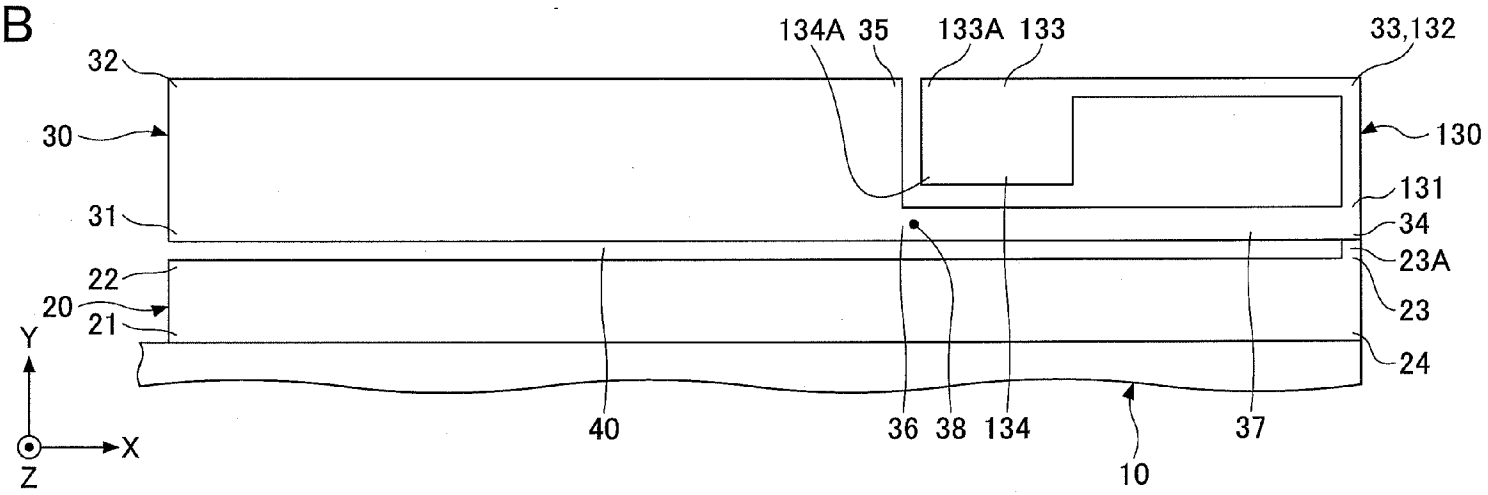

In the communications at the communication frequency f3 (2.2 GHz), a current path has acquired by the line between the end part 121 and the open end 124 of the radiating element 120, as illustrated with bold solid arrows in FIGS. 13A and 13B.

This result indicates that the radiating element 120 serves as a monopole antenna at the communication frequency f3 (2.2 GHz).

Figure 14A:
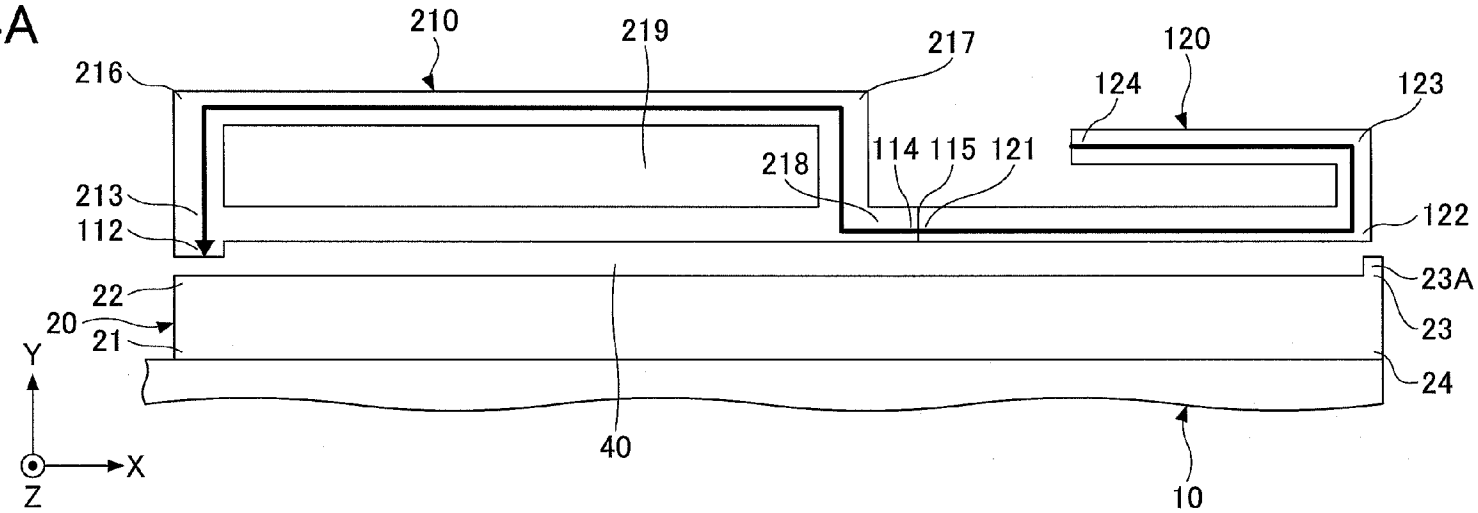
FIGS. 14A to 14B are diagrams illustrating current paths of the radiating element 210, the radiating element 120, and the parasitic element 130.
Figure 14B:
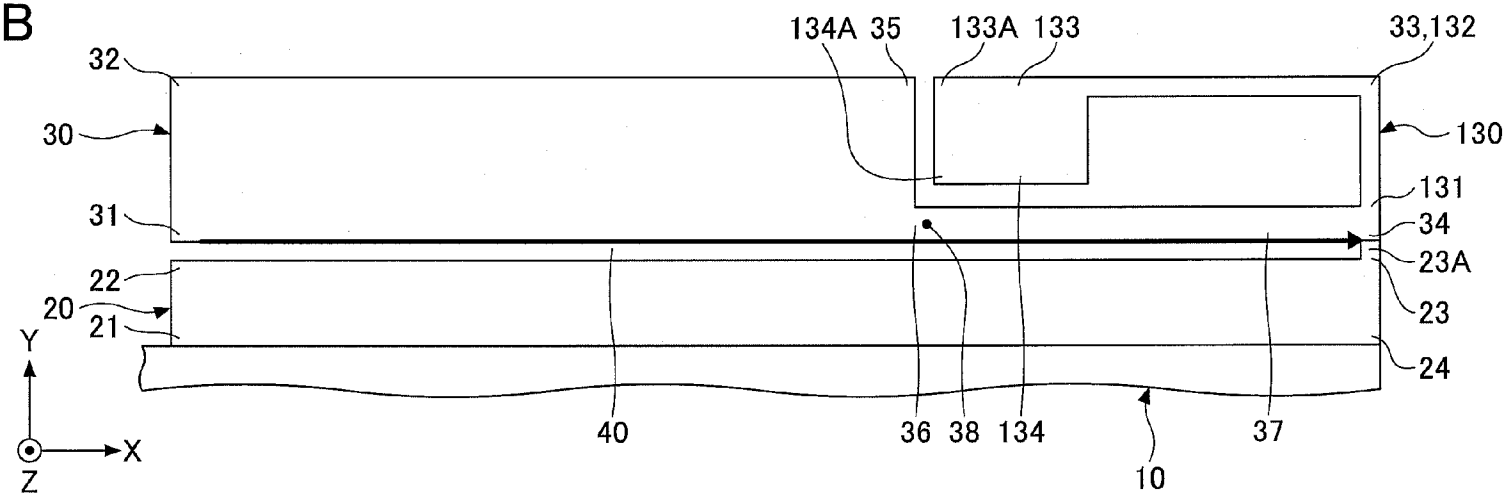

In the communications at the communication frequency f4 (2.5 GHz), a current path has acquired by a path from the open end 124 of the radiating element 120, via the radiating element 120, the bent parts 216 and 217 of the radiating element 210, the ground end 111, and the vertex 31 to the vertex 34 of the ground plane 30, as illustrated with bold solid arrows in FIGS. 14A and 14B.

This result indicates that an antenna capable of performing communications at a harmonics frequency five times greater than the communication frequency f4 may be obtained by setting at five-quarters wavelength of the wavelength $\lambda_4$ at the communication frequency f4 to the length from the open end 124 of the radiating element 120 to the vertex 34 of the ground plane 30 via the radiating element 120, the bent parts 216 and 217 of the radiating element 210, the ground end 111, and the vertex 31.

Figure 15:
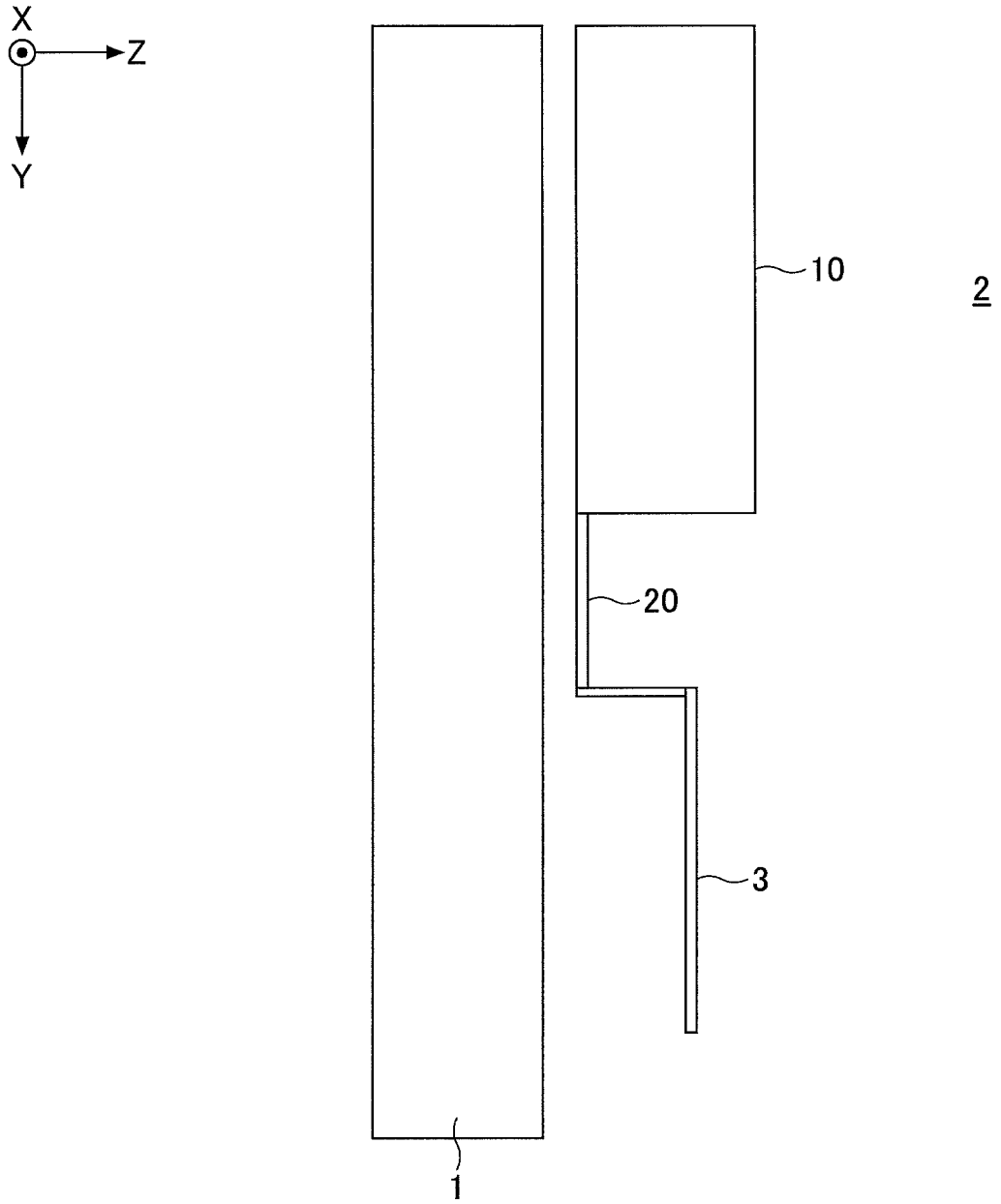
FIG. 15 is a diagram illustrating a simulation model using a phantom 1.

FIG. 15 is a diagram illustrating a simulation model using a phantom 1.

The simulation model using the phantom 1 has analyzed respective SAR distributions generated by an antenna apparatus 2 of a comparative example and the antenna apparatus 200. Note that the simulation model also employs the XYZ coordinate system common to other figures.

The phantom 1 is a simulated human body having electric characteristics (dielectric constant and conductivity) equivalent of electric characteristics of body tissues. This example sets 600 mm to the length in the X axis direction, 400 mm to the length in the Y axis direction, and 200 mm to the length in Z axis direction of the phantom 1. The phantom 1 has a rectangular parallelepiped shape.

The antenna apparatus 2 of the comparative example includes a monopole antenna instead of the radiating element radiating element 120, the radiating element 210, the parasitic element 130, and the ground plane 30 of the antenna apparatus 200. That is, the antenna apparatus 2 of the comparative example includes the monopole antenna 3 and the ground plane 20.

The length of the monopole antenna 3 is set at a ¼ wavelength for performing simulations at different frequencies; that is, at the communication frequency f1 (0.9 GHz), the communication frequency f2 (1.5 GHz), the communication frequency f3 (2.2 GHz), and the communication frequency f4 (2.5 GHz).

The antenna apparatus 2 is disposed at a position 1 mm away in the Z axis direction from the phantom 1, as illustrated in FIG. 15. Similarly, the antenna apparatus 200 is disposed at a position 1 mm away in the Z axis direction from the phantom 1.

The phantom 1 has settings of the dielectric constant of 55.2, the conductivity of 0.97 S/m, and the density of 100 kg/m$^3$ at the communication frequency f1 (0.9 GHz). The phantom 1 has settings of the dielectric constant of 54.0, and the conductivity of 1.20 S/m at the communication frequency f2 (1.5 GHz). The phantom 1 has settings of the dielectric constant of 53.3, and the conductivity of 1.52 S/m at the communication frequency f3 (2.2 GHz) and at the communication frequency f4 (2.5 GHz).

The electric power input to the feeding point 115 is set to 21.5 dBm at all the frequencies f1 to f4 to measure SAR.

FIGS. 16A to 16D are diagrams illustrating results of the simulation using the phantom 1.

FIGS. 16A to 16D illustrate the frequency, the antenna (type), the SAR value (10 g average (w/kg)), and the reduction rate. The antenna type assigned to the antenna apparatus 200 notes "low SAR" and that assigned to the antenna apparatus 2 of the comparative example states "monopole". The reduction rate represents a rate of a SAR value (10 g average (W/Kg)) of the low SAR antenna (the antenna apparatus 200) with respect to that of the antenna apparatus 2 of the comparative example.

As illustrated in FIG. 16A, in a case where the communication frequency is 0.9 GHz (f1), the SAR value of the low SAR antenna (the antenna apparatus 200) is 0.43, the SAR value of the monopole antenna apparatus 2 is 1.20, and the reduction rate is 64.1%.

As illustrated in FIG. 16B, in a case where the communication frequency is 1.5 GHz (f2), the SAR value of the low SAR antenna (the antenna apparatus 200) is 1.63, the SAR value of the monopole antenna apparatus 2 is 2.84, and the reduction rate is 42.6%.

As illustrated in FIG. 16, in a case where the communication frequency is 2.2 GHz (f3), the SAR value of the low SAR antenna (the antenna apparatus 200) is 3.16, the SAR value of the monopole antenna apparatus 2 is 4.41, and the reduction rate is 28.3%.

As illustrated in FIG. 16D, in a case where the communication frequency is 2.5 GHz (f4), the SAR value of the low SAR antenna (the antenna apparatus 200) is 4.18, the SAR value of the monopole antenna apparatus 2 is 5.05, and the reduction rate is 17.2%.

The above-described results indicate that the low SAR antenna (the antenna apparatus 200) may be able to significantly reduce the SAR value compare to each of the monopole antennas of the communications frequencies f1 to f4.

Figure 17:
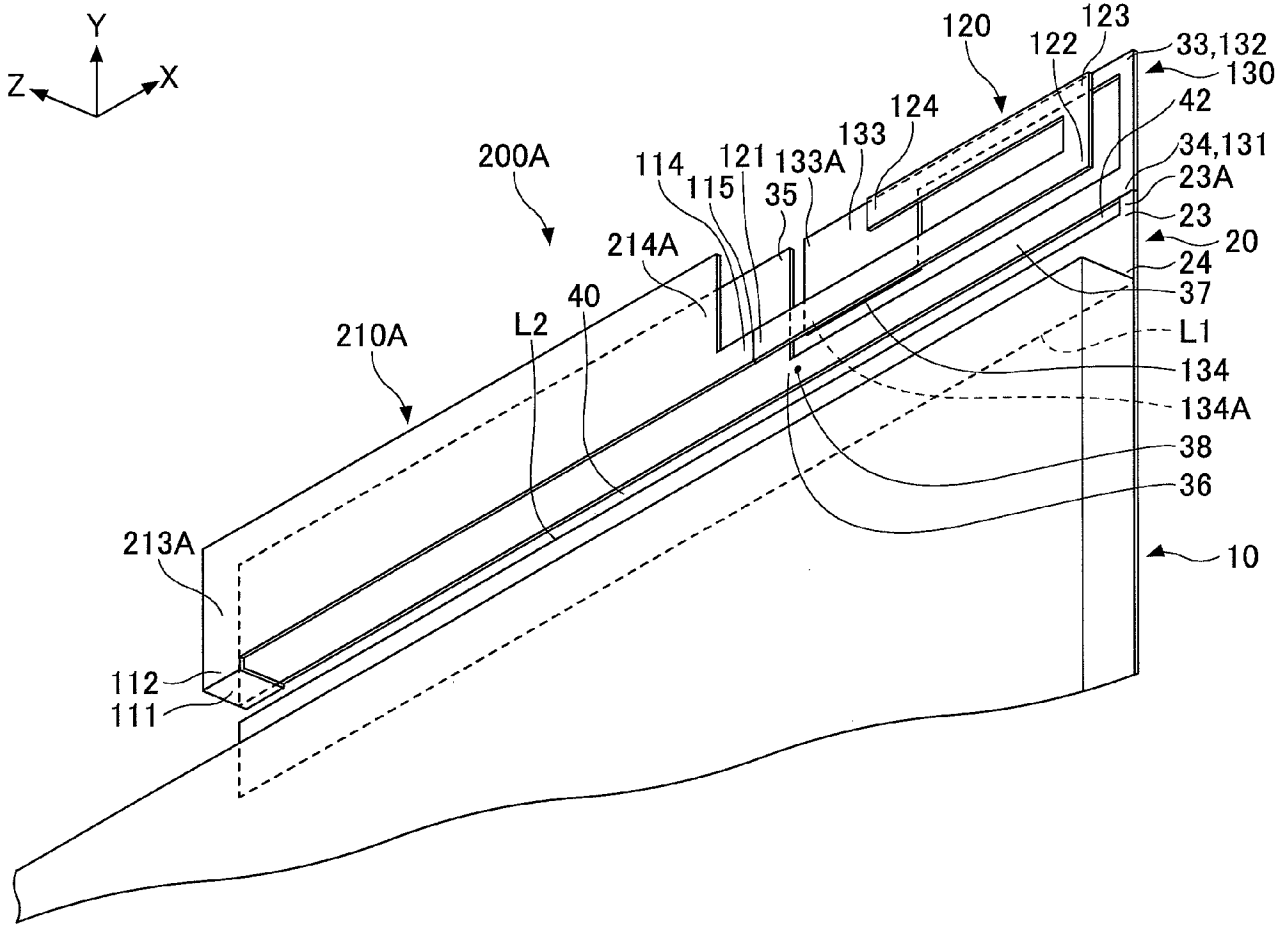
FIG. 17 is a diagram illustrating an antenna apparatus 200A according to a first modification of the second embodiment.

FIG. 17 is a diagram illustrating an antenna apparatus 200A according to a first modification of the second embodiment. A radiating element 210A of the antenna apparatus 200A includes a ground end 111, a bent part 112, a bent part 213A, and an end part 214A.

The radiating element 210A is composed of the radiating element 210 without forming the slot 219 illustrated in FIG. 3. More specifically, the radiating element 210A is composed of the radiating element 110 of the first embodiment having a broader line width between the bent part 113 and the end part 114.

Figure 18:
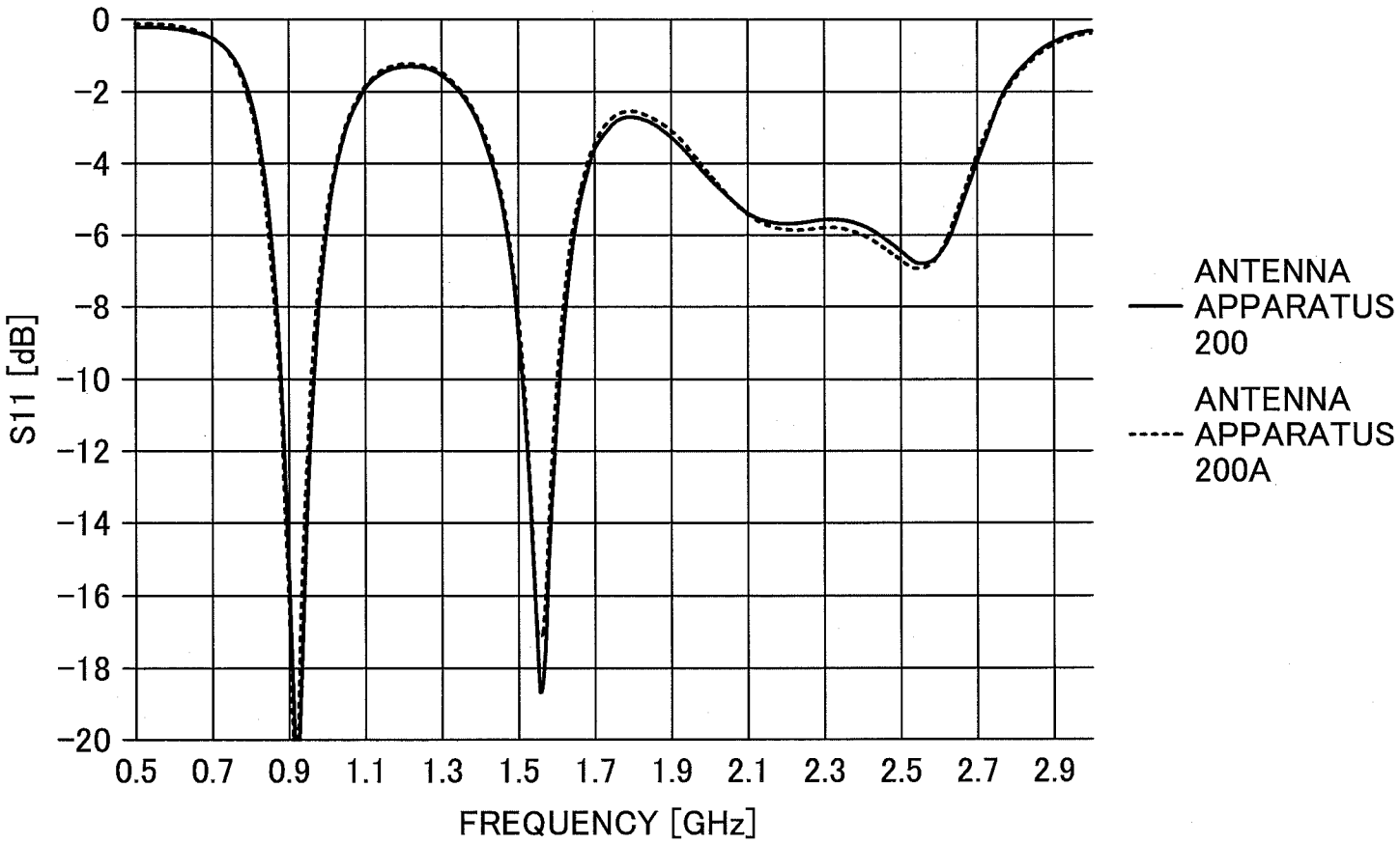
FIG. 18 is a graph illustrating S11-parameters of the antenna apparatus 200 of the second embodiment and the antenna apparatus 200A of the first modification of the second embodiment.

FIG. 18 is a graph illustrating S11-parameters of the antenna apparatus 200 of the second embodiment and the antenna apparatus 200A of the first modification.

As illustrated in FIG. 18, S11-parameters of the antenna apparatus 200 indicate approximately the same values as those for S11-parameters of the first modification at all the frequency bands.

The above results indicate that the antenna apparatus 200A without the 219 has also exhibited the communication frequency f4, and that the radiating element 210A has increased the harmonic current five times greater than the communication frequency f4 compared to the radiating element 110 of the first embodiment.

The first modification of the second embodiment may thus be able to provide the antenna apparatus 200A suitable for performing four-multiband communications.

Figure 19:
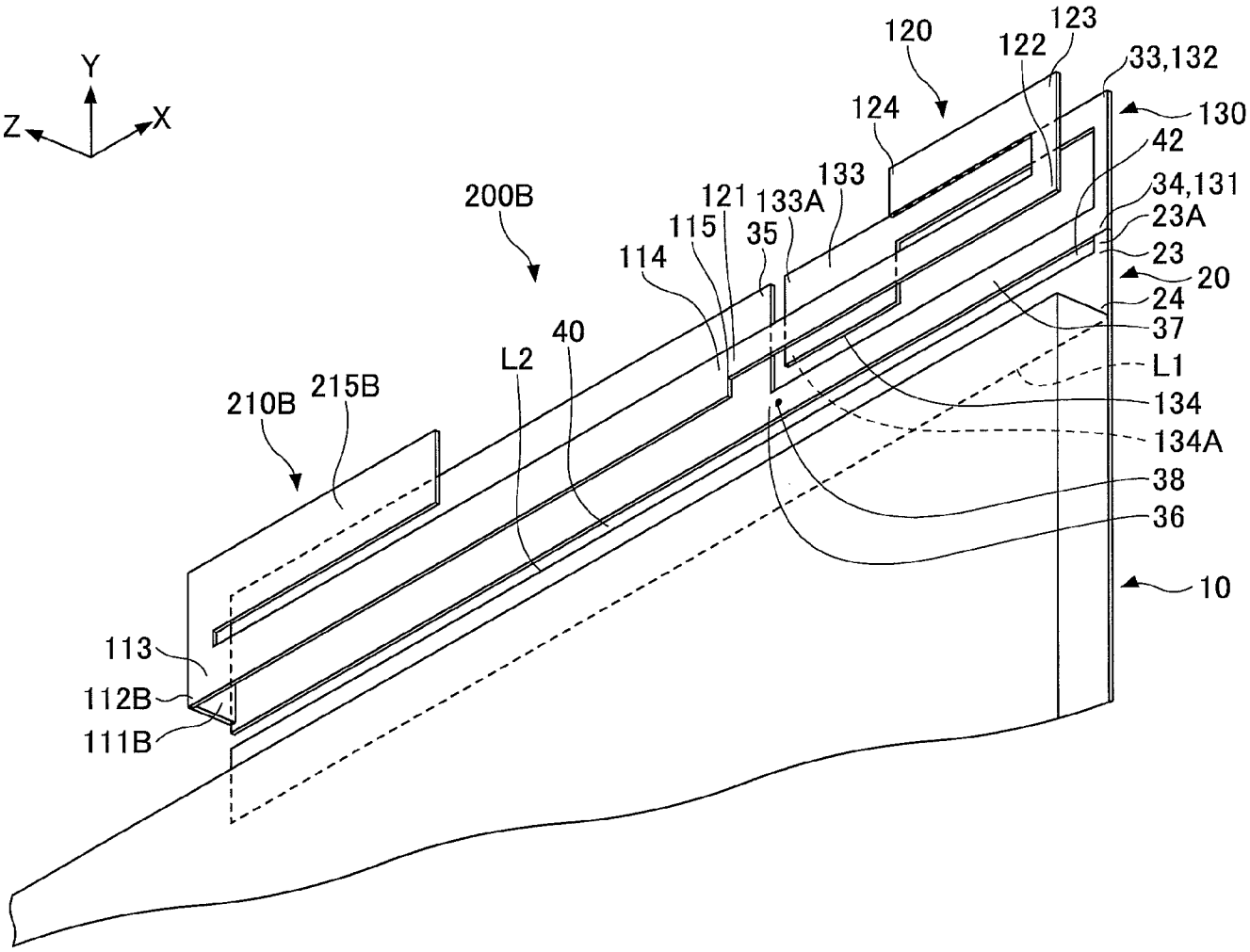
FIG. 19 is a diagram illustrating an antenna apparatus 200B according to a second modification of the second embodiment.

FIG. 19 is a diagram illustrating an antenna apparatus 200B according to a second modification of the second embodiment. A radiating element 210B of the antenna apparatus 200B includes a ground end 111B, a bent part 112B, a bent part 113, an end part 114, and a branch element 215B.

The radiating element 210B is configured to include the branch element 215B split from the bent part 113 that is added to the radiating element 110 illustrated in FIG. 1, change the positions of the ground end 111 and the bent part 112 of the radiating element 110 illustrated in FIG. 1 into positions of the ground end 111B and the bent part 112B.

Hence, the position of the line between the ground end 111 and the bent part 112 of the radiating element 110 illustrated in FIG. 1 is moved to the position of the line between the ground end 111B and the bent part 112B.

The length from the bent part 113 to the tip of the branch element 215B is set one-quarter (¼) wavelength of the wavelength $\lambda_4$ at the communication frequency f1. The branch element 215B functions as a monopole antenna.

FIGS. 20 to 23 are diagrams illustrating dimensions of the antenna apparatus 200B.

The radiating element 210B illustrated in FIGS. 20 to 23 includes the ground end 111 rising from an end part in the X axis direction toward the Z axis direction of the ground plane 30, and bent at the bent part 112B in the X axis direction. The radiating element 210B illustrated in FIGS. 20 to 23 does not include the bent part 113 illustrated in FIG. 19, but includes a line extending from the bent part 112B to the end part 114 and the branch element 215B instead. The radiating element 210B illustrated in FIGS. 20 to 23 may also function in a manner similar to the radiating element 210B illustrated in FIG. 19.

Figure 20:
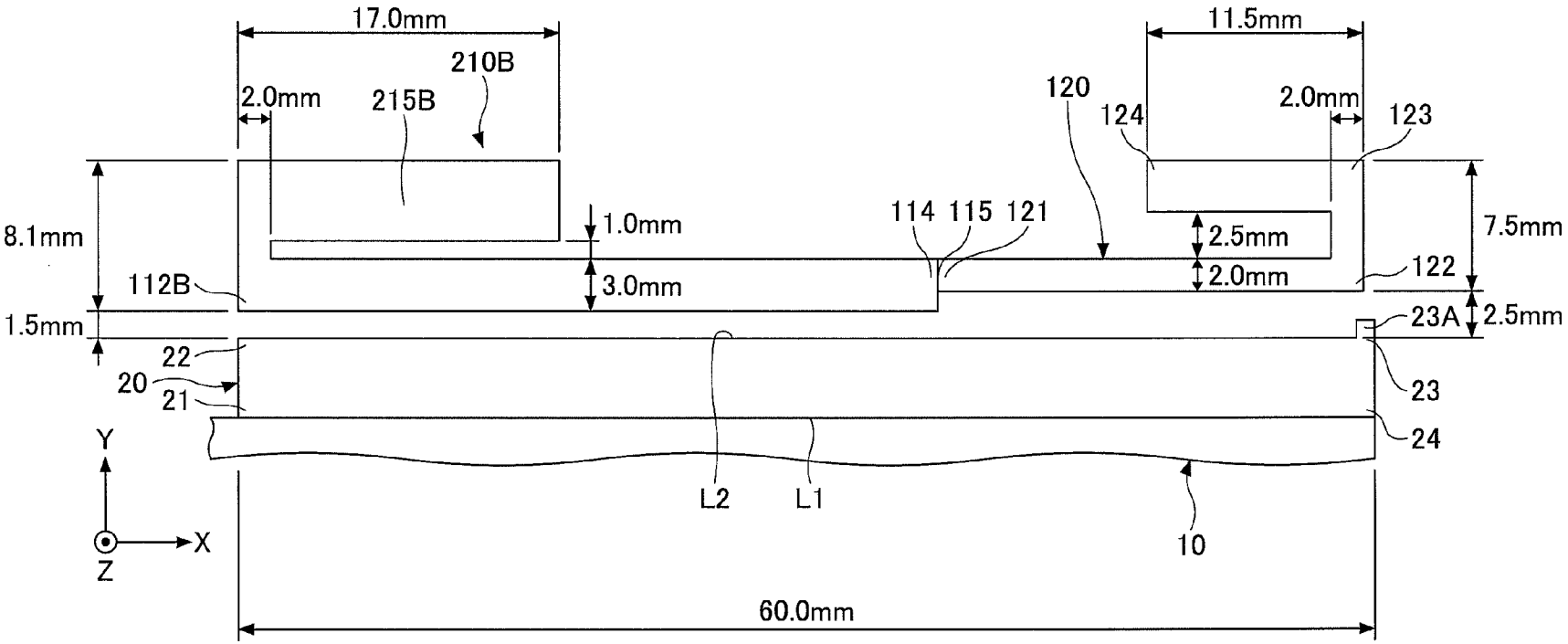
FIG. 20 is a diagram illustrating dimensions of parts in the antenna apparatus 200B.

As illustrated in FIG. 20, the length in the Y axis direction from the bent part 112B to the end part in the positive Y axis direction of the branch element 215B is 8.1 mm, the length in the positive X axis direction of the branch element 215B is 17.0 mm, and the width of the line connecting the bent part 112B and the branch element 215B is 2.0 mm. A gap in the Y axis direction between the line from the bent part 112B to the end part 114 and the branch element 215B is 1.0 mm, the width of the line from the bent part 112B to the end part 114 is 3.0 mm, and a gap in the Y axis direction between the line from the bent part 112B to the end part 114 and the side L2 in plan view is 1.5 mm.

The width of the line from the end part 121 to the bent part 122 is 2.5 mm, the length of the line from the bent part 122 to the bent part 123 is 7.5 mm, the length of the line from the bent part 123 to the open end 124 is 11.5 mm, and a gap between the line from the end part 121 to the bent part 122 and the line from the branching part 213 to the open end 124 is 2.5 mm.

Figure 21:
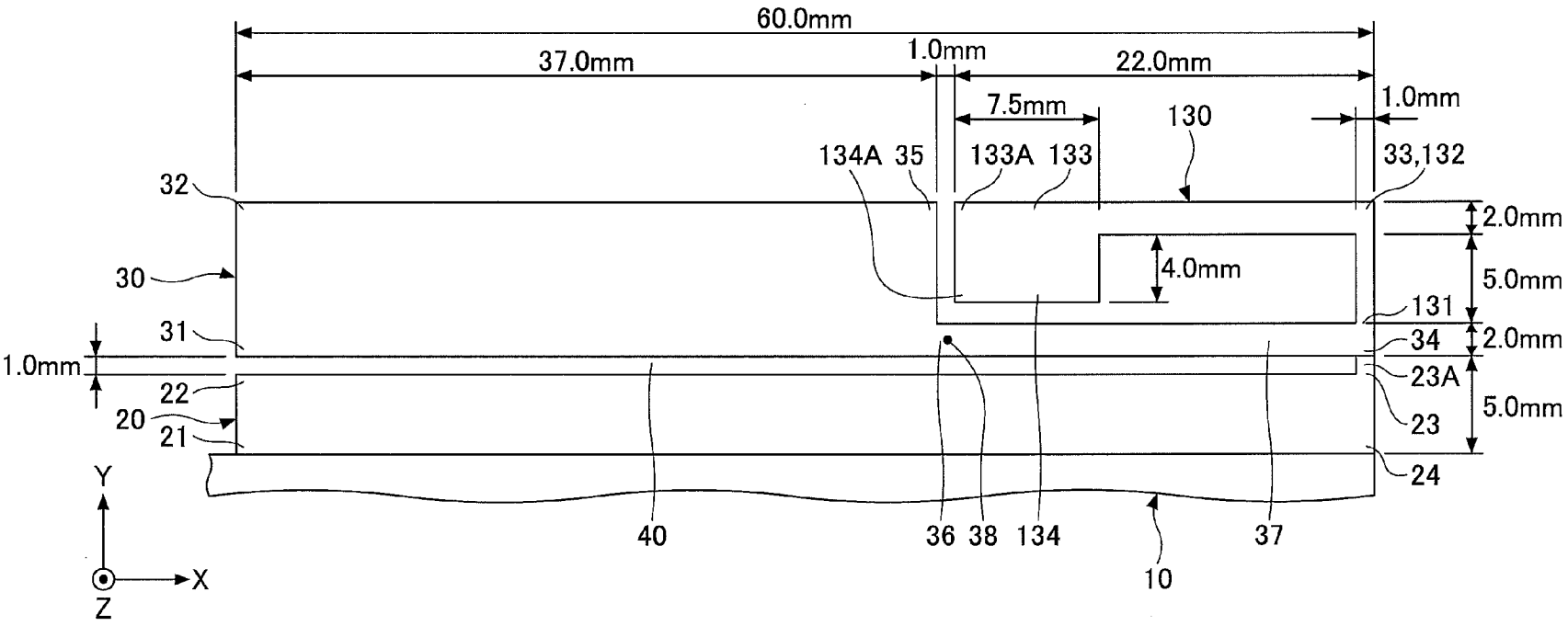
FIG. 21 is a diagram illustrating dimensions of parts in the antenna apparatus 200B.

As illustrated in FIG. 21, the dimensions of the ground plane 20 and the ground plane 30 are similar to those of the ground plane 20 and ground plane 30 illustrated in FIG. 5 except that the width of the line from the bent part 132 to the bent part 133 is changed to 2.0 mm.

Figure 22:
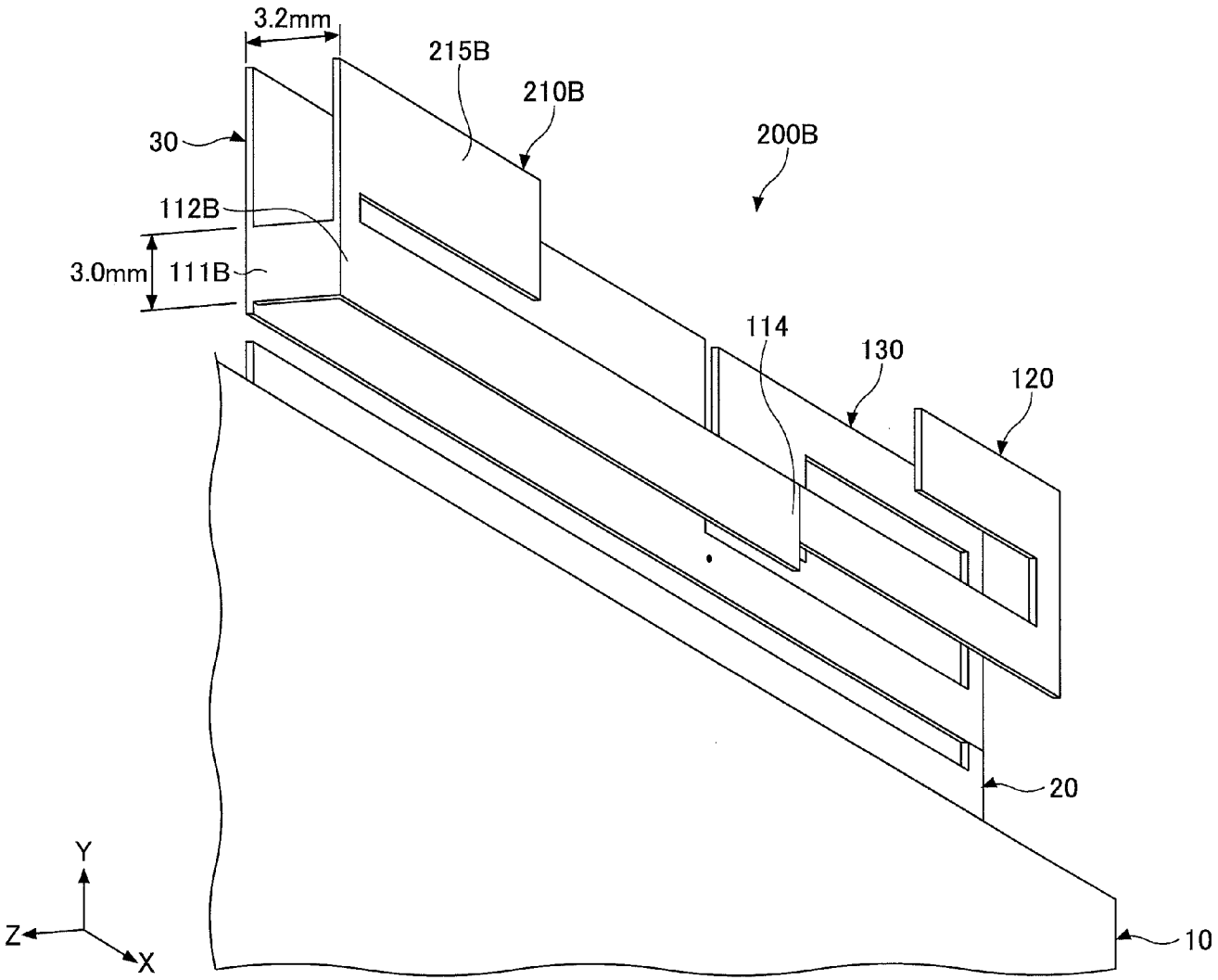
FIG. 22 is a diagram illustrating dimensions of parts in the antenna apparatus 200B.
Figure 23:
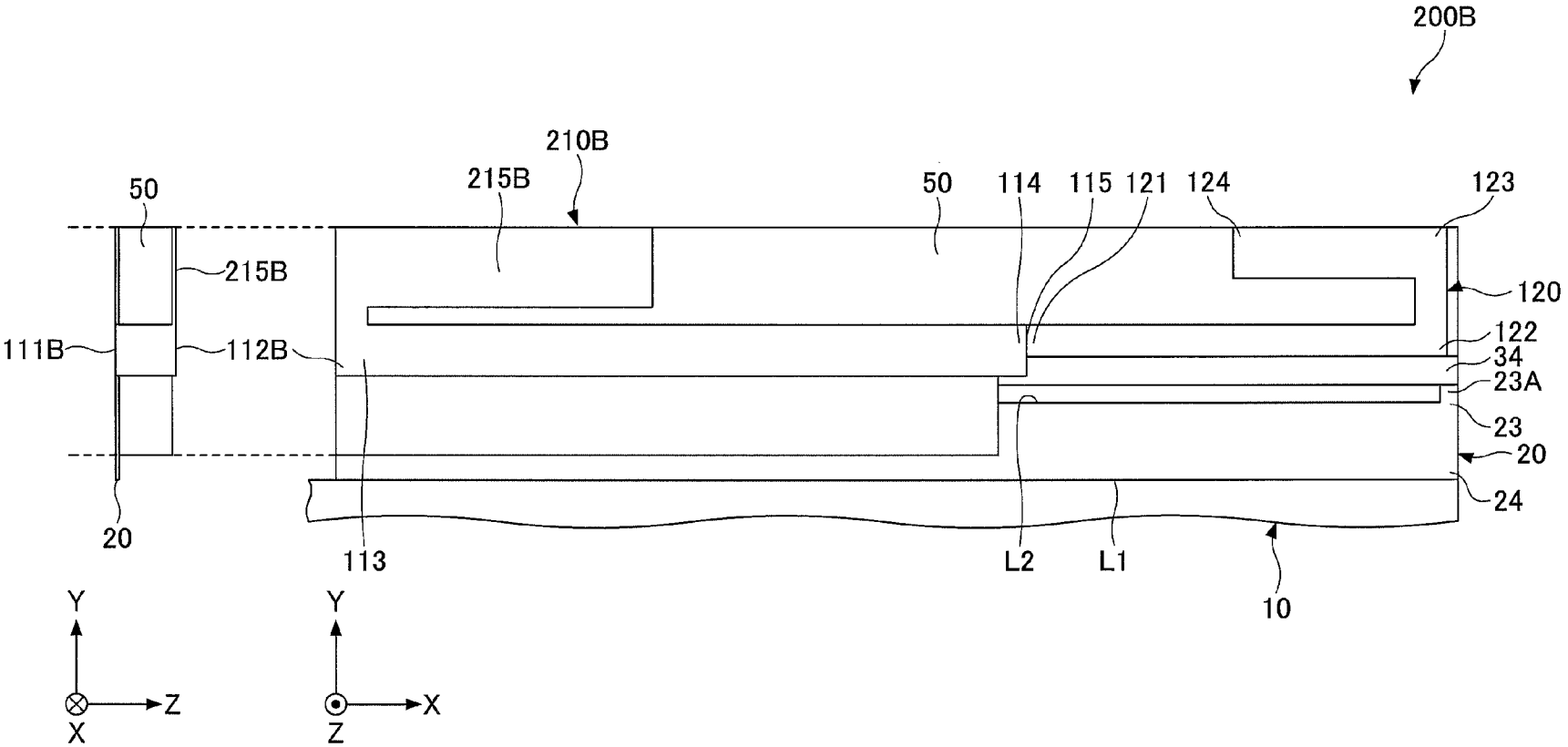
FIG. 23 is a diagram illustrating dimensions of parts in the antenna apparatus 200B.

As illustrated in FIG. 22, the length of the line from the ground end 111B to the bent part 112B in the Z axis direction is 3.2 mm, the width of the line in the Y axis direction is 3.0 mm, and a gap in the Z axis direction between the radiating element 210B and the ground plane is 3.0 mm.

The antenna apparatus 200B further includes a dielectric member 50 between the radiating element 210B and the radiating element 120, and the ground plane 30. The relative dielectric constant of the dielectric member 50 is 2.3.

FIGS. 24A to 27B are diagrams illustrating current paths of the radiating element 210B, the radiating element 120, and the parasitic element 130. The following illustrates the current paths acquired by the electromagnetic field simulation. The communications frequencies f1, f2, f3, and f4 are set at 0.9, 1.6, 2.2, and 2.5 GHz, respectively.

Figure 24A:
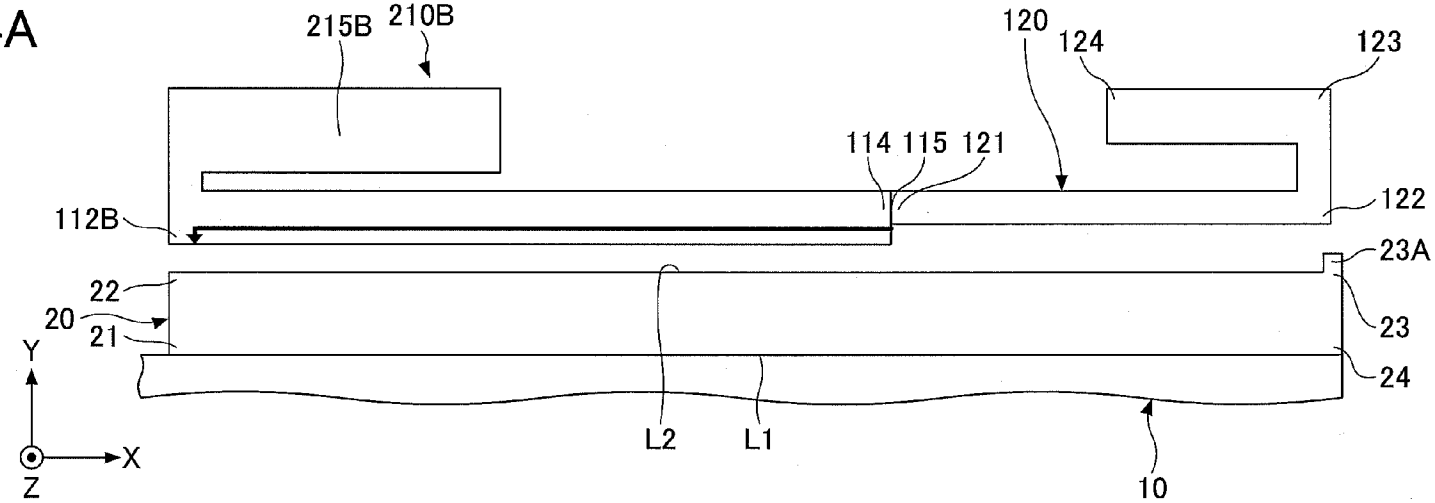
FIGS. 24A to 24B are diagrams illustrating current paths of a radiating element 210B, the radiating element 120, and the parasitic element 130.
Figure 24B:
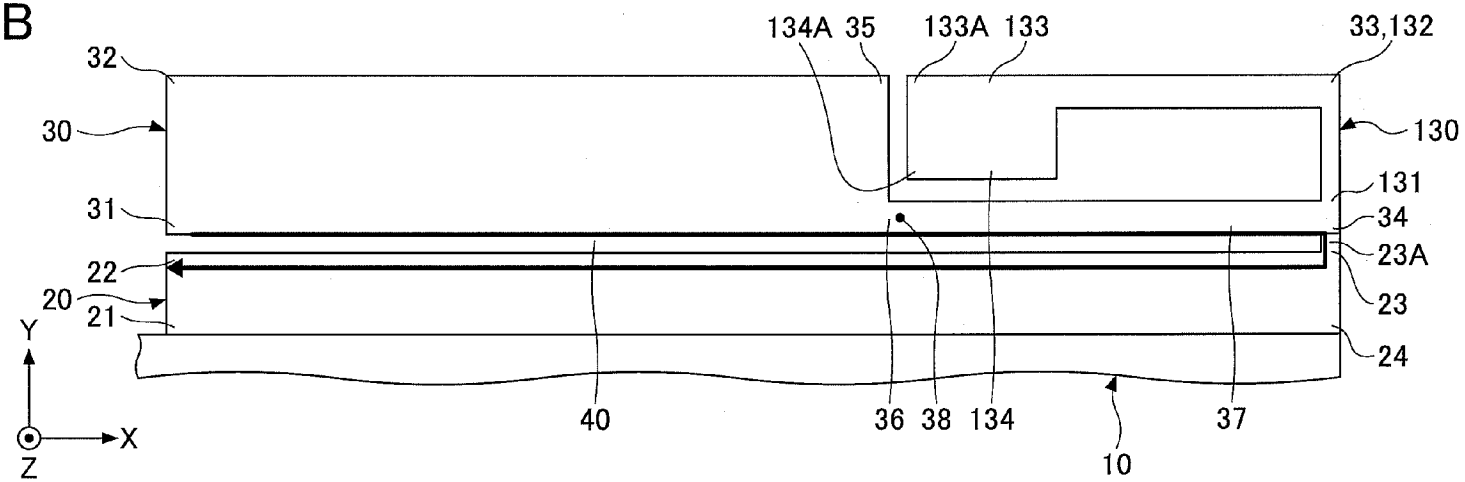

In the communications at the communication frequency f1 (0.9 GHz) using the radiating element 210B, current flows from the feeding point 115, via the radiating element 210, the ground end 111, the ground plane 30, and the connecting part 23A to the vertex 22, as illustrated with bold solid arrows in FIGS. 24A and 24B.

The antenna apparatus 200B of the second modification of the second embodiment has thus acquired the current path for the communication frequency f1 from the feeding point 115, via the radiating element 210B, the ground end 111B, the ground plane 30, and the connecting part 23A to the vertex 22.

The path from the feeding point 115, via the radiating element 210B, the ground end 111B, the ground plane 30, and the connecting part 23A is set at one-half wavelength ($\lambda_1/2$) of the wavelength $\lambda_1$ at the communication frequency f1.

Figure 25A:
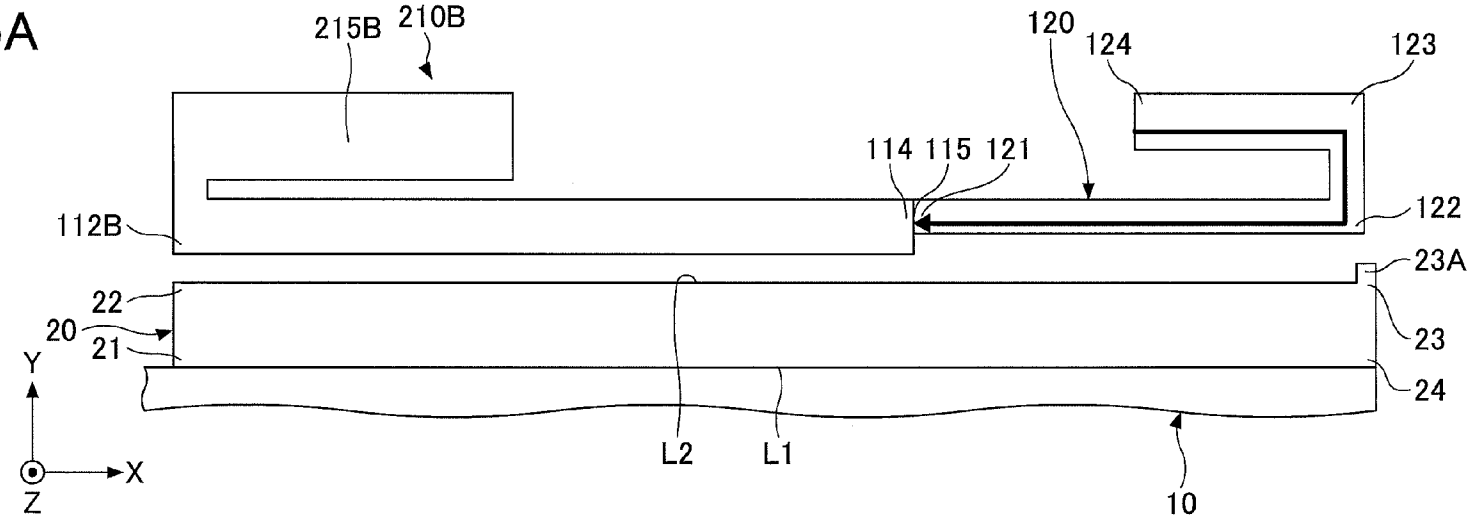
FIGS. 25A to 25B are diagrams illustrating current paths of the radiating element 210B, the radiating element 120, and the parasitic element 130.
Figure 25B:
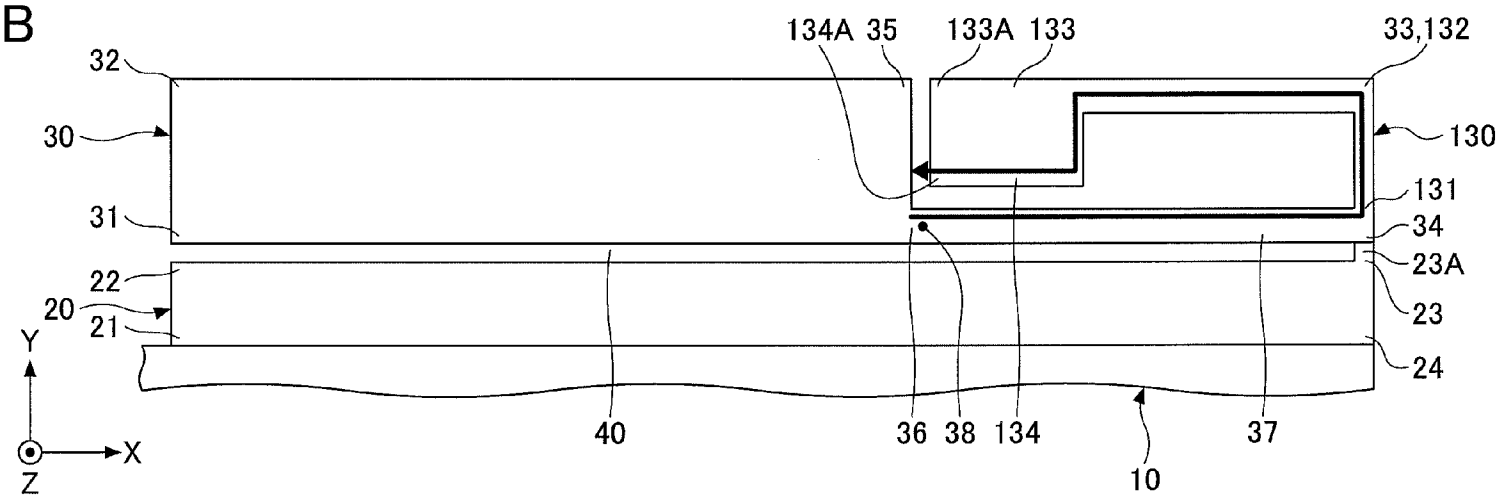

In the communications at the communication frequency f2 (1.6 GHz), a current path has acquired by the line between the end part 121 and the open end 124 of the radiating element 120, and the line from the vertex 36, via the line 37 to the end part 134A of the parasitic element 130, as illustrated with bold solid arrows in FIGS. 25A and 25B.

This result indicates that the radiating element 120, the line 37, and the parasitic element 130 serve as a dipole antenna at the communication frequency f2 (1.6 GHz).

Figure 26A:
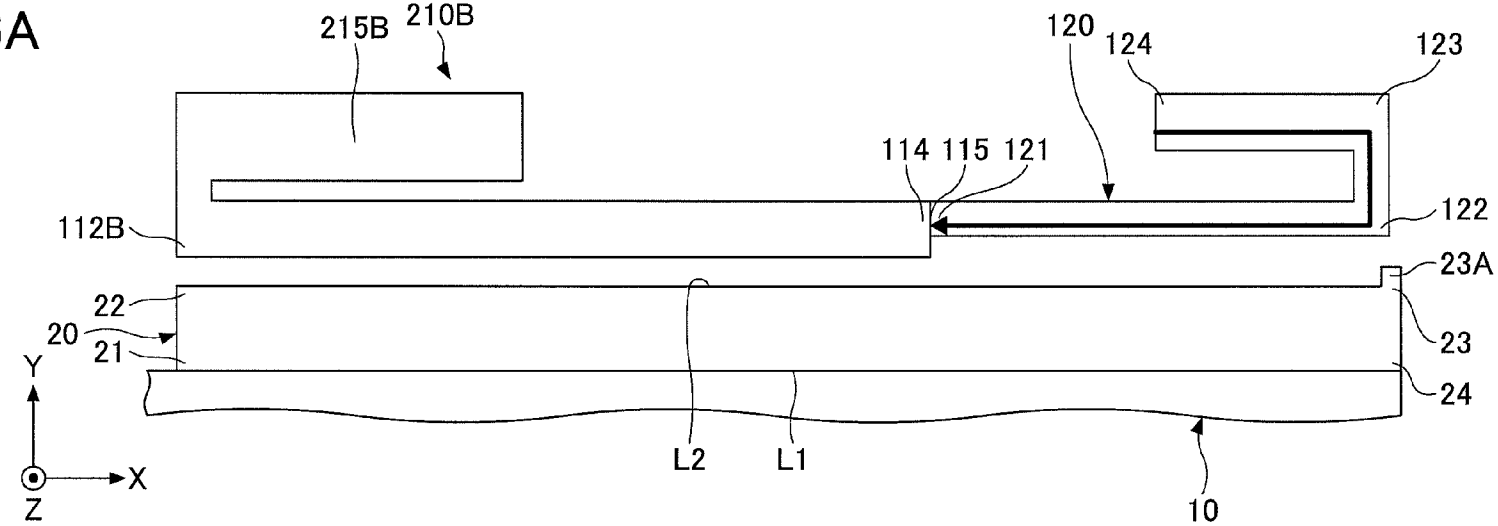
FIGS. 26A to 26B are diagrams illustrating current paths of the radiating element 210B, the radiating element 120, and the parasitic element 130.
Figure 26B:
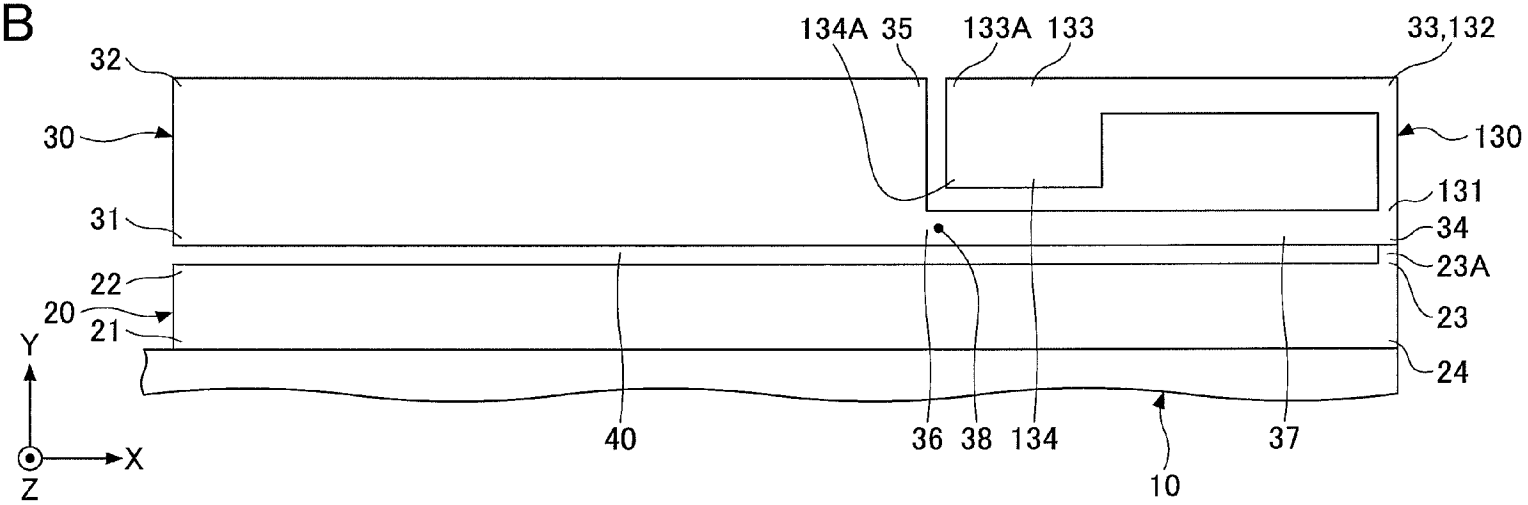

In the communications at the communication frequency f3 (2.2 GHz), a current path has acquired by the line between the end part 121 and the open end 124 of the radiating element 120, as illustrated with bold solid arrows in FIGS. 26A and 26B.

This result indicates that the radiating element 120 serves as a monopole antenna at the communication frequency f3 (2.2 GHz).

Figure 27A:
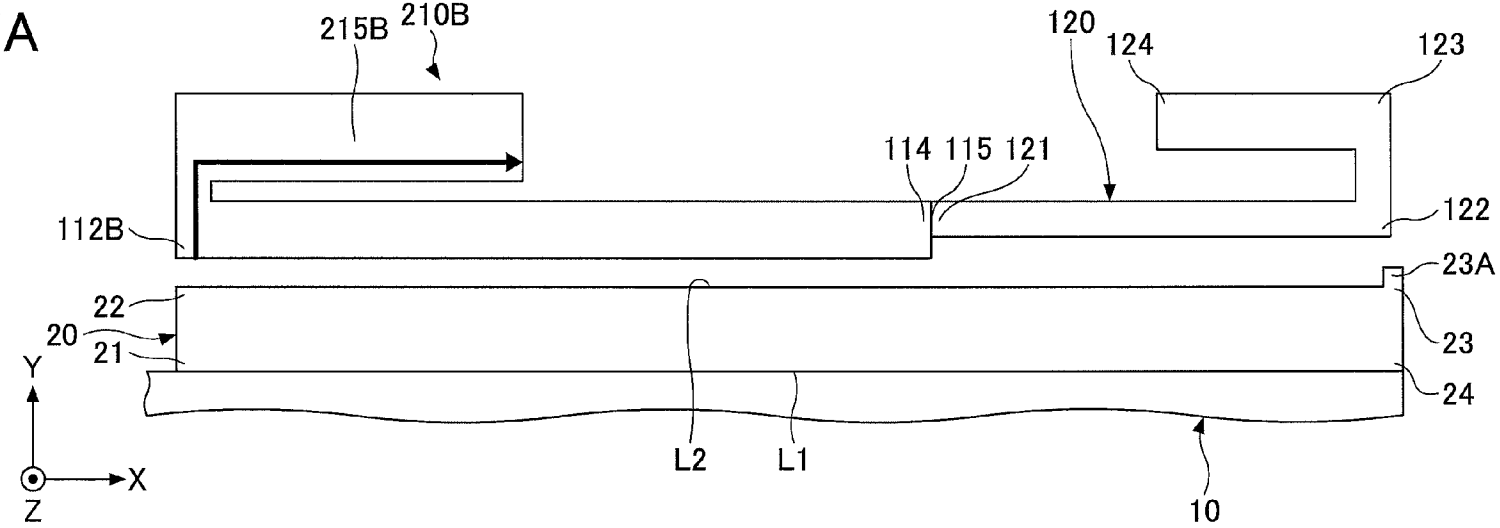
FIGS. 27A to 27B are diagrams illustrating current paths of the radiating element 210B, the radiating element 120, and the parasitic element 130.
Figure 27B:
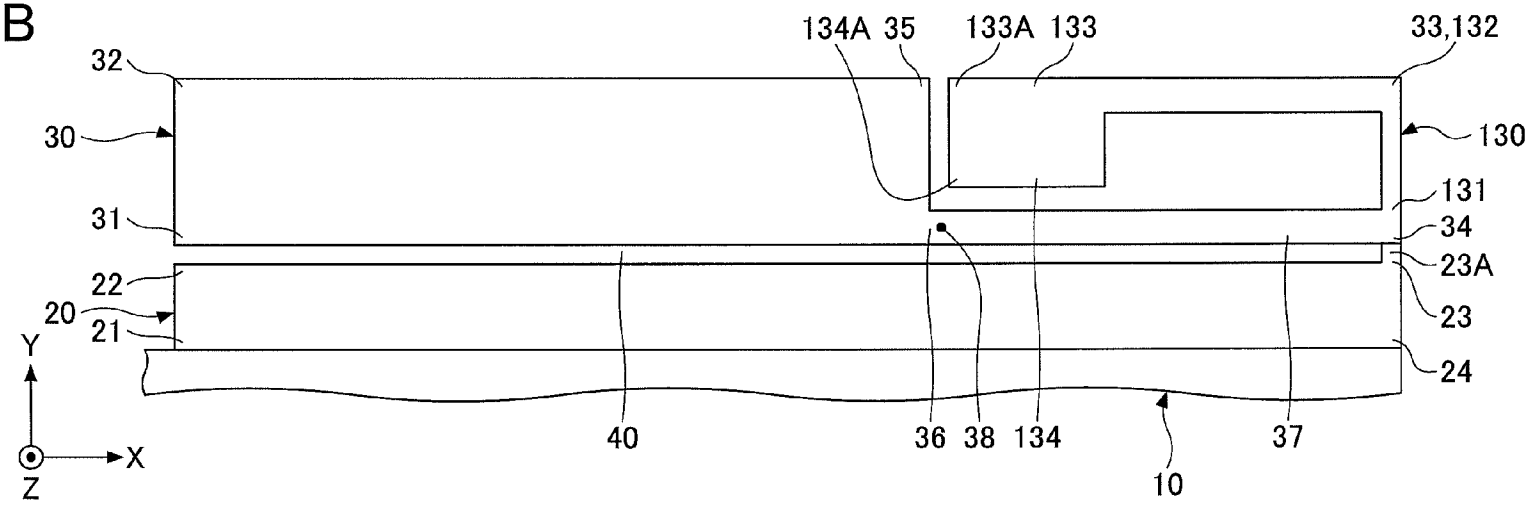

In the communications at the communication frequency f4 (2.5 GHz), a current path has acquired by a path from the bent part 113 of the radiating element 120 to the tip of the branch element 215B, as illustrated with bold solid arrows in FIGS. 27A and 27B.

This result indicates that the branch element 215B may be able to serve as a monopole antenna capable of performing communications at the communication frequency f4 by setting the length of the path from the bent part 113 of the radiating element 120 to the tip of the branch element 215B to the one-quarter (¼) wavelength at the communication frequency f4.

The second modification of the second embodiment may thus be able to provide the antenna apparatus 200B suitable for performing four-multiband communications.

The embodiments discussed above may provide the antenna apparatus suitable for performing multiband communications.

All examples and conditional language recited herein are intended for pedagogical purposes to aid the reader in understanding the invention and the concepts contributed by the inventor to furthering the art, and are to be construed as being without limitation to such specifically recited examples and conditions, nor does the organization of such examples in the specification relate to a showing of the superiority or inferiority of the invention. Although the embodiments of the present invention have been described in detail, it should be understood that the various changes, substitutions, and alterations could be made hereto without departing from the spirit and scope of the invention.

What is claimed is:

1. An antenna apparatus comprising:

a first ground plane having an end-side;

a second ground plane having a first side disposed along the end-side, the first side having a first end and a second end, a second side and a third side extending from the first end and the second end, respectively, in a direction away from the end-side in plan view, a fourth side connecting the second side and the third side, and a cutout part having a rectangular shape provided along the fourth side between the third side and a fifth side located between the second side and the third side, the second ground plane being cutout in the cutout part, wherein the second end is connected to the first ground plane, and the second ground plane and the first ground plane form a slit between the second ground plane and the first ground plane in plan view, the slit having an open end located on aside of the first end;

a first radiating element having a first line standing from a ground end with respect to the second ground plane, the first line being connected to the second ground plane in a vicinity of the first end of the first side, a second line connected to the first line, the second line extending toward the third side along the fourth side to an end part, the end part located opposite to the ground end, and a feeding point disposed at the end part of the second line;

a second radiating element having a third line connected to the end part of the first radiating element, the third line extending along the fourth side toward the third side, and a fourth line connected to the third line, the fourth line extending along the third side in a direction away from the first ground plane in plan view; and a parasitic element having a first parasitic line extending from the second end along the third side within the rectangular area, and a second parasitic line connected to the first parasitic line, the second parasitic line extending toward the second side along the fourth side within the rectangular area, wherein a length from the feeding point, via the first radiating element, the ground end, the second end, and the end-side to the open end of the slit is set to a one-half wavelength long at a first communication frequency, wherein a total length of a length from an end part of the fourth line of the second radiating element to the feeding point, and a length from a ground potential point of the second ground plane corresponding to the feeding point to an end part of the second parasitic line of the parasitic element is set to a one-half wavelength long at a second communication frequency higher than the first communication frequency, and wherein a length of the third line and the fourth line of the second radiating element is set to a one-quarter wavelength long at a third communication frequency higher than the second communication frequency.

2. The antenna apparatus as claimed in claim 1, wherein a line width of the second line of the radiating element is greater than a line width of the first line, and a line width of the third line and the fourth line.

3. The antenna apparatus as claimed in claim 2, wherein the second line of the radiating element includes one or a plurality of slots disposed in an extending direction of the second line.

4. The antenna apparatus as claimed in claim 1, wherein the radiating element further includes a branch element branched off from a connection point between the first line and the second line, the branch element extending along the second line on an opposite side of the first ground plane in plan view with respect to the second line, and wherein a length from the connection point to a tip of the branch element is set to a one-quarter wavelength long at a fourth communication frequency higher than the third communication frequency.

5. The antenna apparatus as claimed in claim 1, wherein the radiating element includes an extended line disposed on a tip of the fourth line, the extended line bending from a direction away from the ground plane along the fourth side and extending toward the second side, wherein a total length of a length from an end part of the extended line of the second radiating element to the feeding point, and a length from the ground potential point of the second ground plane to the end part of the second parasitic line of the parasitic element is set to a one-half wavelength long at a second communication frequency higher than the first communication frequency, and wherein a length of the third line and the fourth line including the extended line of the second radiating element is set to a one-quarter wavelength long at a third communication frequency.

6. The antenna apparatus as claimed in claim 1, wherein the parasitic element includes a parasitic extended line on a tip of the second parasitic line, the parasitic extended line bending from a direction toward the second side along the fifth side and extending toward the first side within the rectangular area, wherein a total length of a length from the end part of the fourth line of the second radiating element to the feeding point, and a length from the ground potential point to an end part of the parasitic extended line of the parasitic element is set to a one-half wavelength long at a second communication frequency higher than the first communication frequency, and wherein a line width of the parasitic extended line of the second parasitic line is greater than a line width of a remaining line of the second parasitic line disposed on a side of the first parasitic line.

7. The antenna apparatus as claimed in claim 1, further comprising:

a dielectric member disposed between the second ground plane and the second line of the first radiating element.

8. The antenna apparatus, as claimed in claim 1, wherein a height of the first radiating element with respect to the second ground plane is equal to a height of the second radiating element with respect to the second ground plane.

* * * * *